US012595093B2

(12) United States Patent
Sakai et al.

(10) Patent No.: US 12,595,093 B2
(45) Date of Patent: Apr. 7, 2026

(54) PACKING BOX

(71) Applicant: CANON KABUSHIKI KAISHA, Tokyo (JP)

(72) Inventors: Hideto Sakai, Tokyo (JP); Kazunari Iwai, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 172 days.

(21) Appl. No.: 18/473,458

(22) Filed: Sep. 25, 2023

(65) Prior Publication Data

US 2024/0101306 A1 Mar. 28, 2024

(30) Foreign Application Priority Data

Sep. 28, 2022 (JP) ..... 2022-155603

(51) Int. Cl.
*B65D 5/66* (2006.01)
*B65D 5/02* (2006.01)
*B65D 5/42* (2006.01)

(52) U.S. Cl.
CPC ..... *B65D 5/6602* (2013.01); *B65D 5/0227* (2013.01); *B65D 5/4266* (2013.01)

(58) Field of Classification Search
CPC .. B65D 27/30; B65D 55/026; B65D 2401/00; B65D 5/0254
USPC ..... 229/102, 237, 208, 240, 207, 81; 206/807; 493/86; 383/5; 428/915, 916
See application file for complete search history.

(56) References Cited

U.S. PATENT DOCUMENTS 4,566,627 A * 1/1986 Gendron ..... B65D 27/30 229/81
4,746,052 A * 5/1988 Schmissrauter ..... B65D 5/42 229/102
4,746,061 A * 5/1988 Arvanigian ..... B65D 5/0236 229/102
4,972,953 A * 11/1990 Friedman ..... B65D 55/026 229/102
5,358,176 A * 10/1994 Rigby ..... B65D 5/5455 229/227
6,138,905 A * 10/2000 Hachenski ..... B65D 5/5425 229/207
8,746,540 B2 * 6/2014 Hultberg ..... B65D 5/0227 229/102
10,577,144 B2 * 3/2020 Buss ..... B65D 5/0236
(Continued)

FOREIGN PATENT DOCUMENTS

JP 2012240736 A 12/2012

*Primary Examiner* — Christopher R Demeree
(74) *Attorney, Agent, or Firm* — ROSSI, KIMMS & McDOWELL LLP

(57) ABSTRACT

A packing box formed of corrugated paper having a corrugated medium with ridges and grooves arrayed in an array direction, including a first side part, a second side part opposed to the first side part, an inner lid part bent along a first edge portion of the first side part, an outer lid part bent along a second edge portion of the second side part, and an adhesion part for bonding an outer surface of the inner lid part and an inner surface of the outer lid part. The inner surface of the outer lid part is provided with the adhesion part and a score part along the adhesion part. The score part is provided between an edge opposite to the second edge portion and the adhesion part. The score part has a score that does not reach an outer surface of the outer lid part.

14 Claims, 16 Drawing Sheets

(56) References Cited

U.S. PATENT DOCUMENTS

2005/0145683 A1* 7/2005 Alagna ..... B65D 5/541
229/222
2010/0181371 A1* 7/2010 Messmer ..... B65D 5/4233
229/102

* cited by examiner

PACKING BOX

BACKGROUND OF THE INVENTION

Field of the Invention

The present invention relates to a packing box for use in packing an object to be packed.

Description of the Related Art

A packing box is for housing an object to be packed in order to, for example, guarantee the quality of the object to be packed from the time at which the object to be packed is packed in the packing box until the packing box is opened for using the object to be packed. Some packing boxes have a structure leaving a trace of opening. A trace of opening being left behind makes it difficult to reassemble a once-opened packing box and to disguise the once-opened packing box as being unopened. For this reason, it is possible to prevent a fraud such as disguising of a fraudulent product packed in a genuine packing box as a genuine product. Examples of the structure leaving a trace of opening may include a structure in which a broken figure is drawn with a through score or a half score in corrugated paper forming a packing box, and the broken figure is broken, by opening, in a hardly restorable form. In a case where a score is made in the corrugated paper forming a packing box, buckling is caused at the corrugated medium of the corrugated paper upon application of a load on the packing box, which may reduce the strength of the packing box. Japanese Patent Application Publication No. 2012-240736 discloses a technology of suppressing the reduction of the strength of a packing box in a case where a score is made in the corrugated paper forming the packing box.

With the technology disclosed in Japanese Patent Application Publication No. 2012-240736, it is difficult to prevent a wrongdoing of reassembling a packing box after opening and disguising the once-opened packing box as being unopened while suppressing the reduction of the strength of the packing box.

SUMMARY OF THE INVENTION

It is an object of the present invention to provide a packing box difficult to disguise as being unopened by reassembly after opening while suppressing the strength reduction.

The present invention is a packing box formed of corrugated paper having a corrugated medium with a plurality of ridges and grooves arrayed in an array direction, the packing box including:

a first side part extending in a first direction and a second direction intersecting the first direction, the first side part having a first edge portion at an edge in the first direction of the first side part and extending in the second direction;

the second side part being opposed to the first side part and extending in the first direction and the second direction, the second side part having a second edge portion being on the same side as the first edge portion in the first direction and extending in the second direction;

an opening surrounded by the first edge portion of the first side part and the second edge portion of the second side part;

an inner lid part provided to be bent along a first bending line so as to close at least a part of the opening and extending in the second direction and a third direction intersecting the first direction and the second direction, the first bending line extending in the second direction at the first edge portion of the first side part;

an outer lid part provided to be bent along a second bending line and extending in the second direction and the third direction, an inner surface of the outer lid part overlapping at least a part of an outer surface of the inner lid part from outside, the second bending line extending in the second direction at the second edge portion of the second side part; and an adhesion part for bonding the inner surface of the outer lid part and the outer surface of the inner lid part, wherein the outer lid part is configured such that the array direction of the ridges and grooves of the corrugated medium is the third direction, and the inner surface of the outer lid part is provided with a score part between an edge opposite to the second bending line in the third direction and the adhesion part, the score part has a score provided along the second direction, and the score does not reach an outer surface opposite to the inner surface of the outer lid part.

The present invention can provide a packing box difficult to disguise as being unopened by reassembling after opening while suppressing the strength reduction.

Further features of the present invention will become apparent from the following description of exemplary embodiments with reference to the attached drawings.

DESCRIPTION OF THE EMBODIMENTS

Below, a packing box in accordance with the present invention will be described in detail by reference to the accompanying drawings.

A description will be given to one embodiment of the packing box in accordance with the present invention. The packing box is for housing an object to be packed in order to guarantee the quality of the object to be packed from the time at which the object to be packed is packed in the packing box until the packing box is opened for using the object to be packed, or for other purposes. In the present Example, a description will be given by taking the case where the to-be-packed object to be packed in a packing box is a cartridge detachable with respect to the apparatus main body of the image forming apparatus as an example. Assumedly, at the time of mounting a brand-new cartridge to the apparatus main body of the image forming apparatus, a user opens the packing box, takes out the brand-new cartridge from the packing box, and mounts the cartridge in the apparatus main body of the image forming apparatus. First, the image forming apparatus, and the cartridge as the object to be packed will be described. Then, the half score to be provided in the packing box will be described, followed by description of the packing box.

1. Image Forming Apparatus

Examples of the image forming apparatus may include a copier, a printer (e.g., a laser beam printer or a LED printer), a facsimile device, and a word processor. Further, a cartridge is configured detachably with respect to the apparatus main body of the image forming apparatus. Examples of the cartridge may include the one obtained by integrally forming a photosensitive member as an image bearing member, and a processing means such as a development means acting thereon into a cartridge, the one obtained by forming substantially only a development means into a cartridge, and the one obtained by forming substantially only a developer container into a cartridge. Incidentally, the apparatus main body of the image forming apparatus corresponds to the portion of the image forming apparatus except for the cartridge. With this cartridge system, a user himself/herself can perform the replenishment of a developer and the maintenance of the apparatus in the form of replacement of the cartridge. For this reason, the operability can be improved remarkably.

Figure 1:
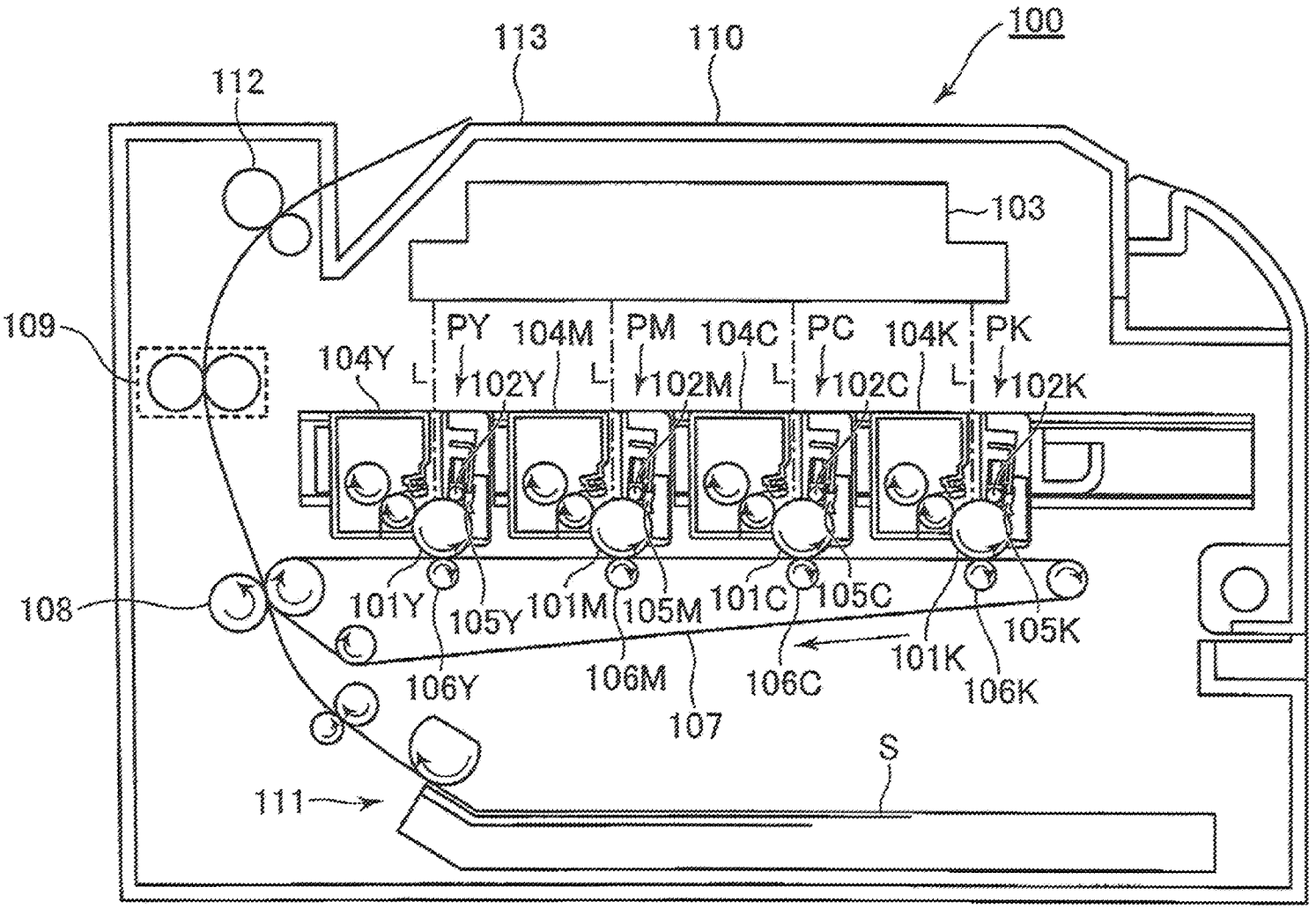
FIG. 1 is a schematic cross-sectional view of an image forming apparatus.
Figure 2:
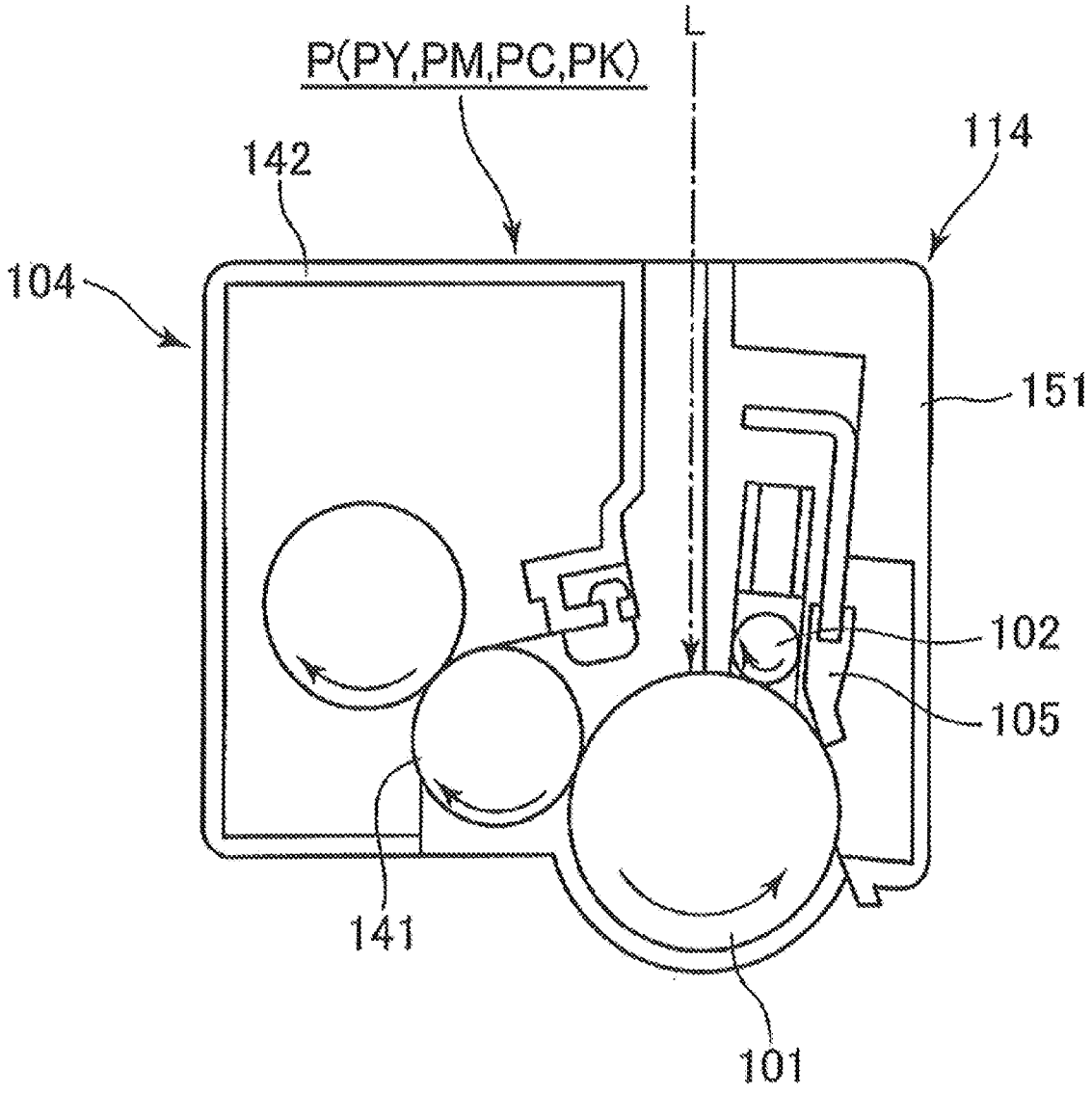
FIG. 2 is a schematic cross-sectional view of a cartridge.

FIG. 1 is a schematic cross-sectional view of an image forming apparatus 100 with respect to which a cartridge P (PY, PM, PC, or PK) as an object to be packed of the packing box of the present Example is detachable. FIG. 2 is a schematic cross-sectional view of the cartridge P (PY, PM, PC, or PK).

The image forming apparatus 100 is a full color laser beam printer using an electrophotographic process and adopts a cartridge system. The image forming apparatus 100 is configured such that four cartridges (process cartridges) P (PY, PM, PC, and PK) for forming images in respective colors of yellow (Y), magenta (M), cyan (C), and black (K), respectively are set detachably with respect to an apparatus main body 110. Incidentally, the elements having the same or corresponding functions or configurations provided for respective colors may be described collectively by omitting Y, M, C, and K at the end of the reference sign indicative of the element provided for some color. Further, the apparatus main body 110 of the image forming apparatus 100 corresponds to the portion of the image forming apparatus 100 except for the cartridge P.

The image forming apparatus 100 can form a full color image on a recording medium (a recording material, a transfer material, or a sheet) S by mounting the cartridge P in the apparatus main body 110 detachably. Examples of the recording medium S may include recording paper, label paper, an OHP sheet, and cloth. The image forming apparatus 100 is configured such that first, second, third, and fourth cartridges PY, PM, PC, and PK are arranged in the substantially horizontal direction inside the apparatus main body 110. The apparatus main body 110 has a laser scanner 103 as an optical means, a primary transfer roller 106 as a transfer means, an intermediate transfer belt 107 and a secondary transfer roller 108, a fixing apparatus 109 as a fixing means, a feeding part 111 as a feeding means of the recording medium S, and the like.

Each cartridge P is configured such that a drum unit 114 and a developing apparatus (development unit) 104 are coupled with each other. The cartridges P for respective colors respectively have the same electrophotographic process mechanism and are different in color of the toner as a developer for use in development. The drum unit 114 has a photosensitive drum 101 (101Y, 101M, 101C, or 101K) of an electrophotographic photosensitive member of a drum type rotatable as an image bearing member. Further, the drum unit 114 has a charging roller 102 (102Y, 102M, 102C, or 102K) as a charging means as the process means acting on the photosensitive drum 101. Further, the drum unit 114 has a cleaning blade 105 (105Y, 105M, 105C, or 105K) as a cleaning means as the process means. The drum unit 114 is configured such that the photosensitive drum 101, the charging roller 102, the cleaning blade 105, and the like are supported by a cleaning frame body 151. On the other hand, the developing apparatus 104 has a development roller (developer bearing member) 141 as a development means as the process means acting on the photosensitive drum 101. The developing apparatus 104 is configured such that the development roller 141 and the like are supported by a development frame body 142. First, second, third, and fourth cartridges PY, PM, PC, and PK house toners of respective colors of yellow, magenta, cyan, and black in their respective development frame bodies 142, respectively.

The photosensitive drum 101 is rotationally driven in the counterclockwise direction in FIG. 1. The surface of the rotating photosensitive drum 101 is uniformly subjected to a charging treatment to a prescribed electric potential of a prescribed polarity (in the present Example, the negative polarity) by the charging roller 102. At the time of charging, the charging roller 102 is applied with a prescribed charging voltage by a voltage application means provided at the apparatus main body 110. The surface of the photosensitive drum 101 subjected to a charging treatment is irradiated with a laser light L in accordance with the image information corresponding to each cartridge P by the laser scanner 103 for scanning exposure. As a result of this, on the surface of the photosensitive drum 101, an electrostatic latent image (electrostatic image) in accordance with the image information corresponding to each cartridge P is formed. The electrostatic latent image formed on the photosensitive drum 101 is supplied with a toner by the developing apparatus 104, thereby to be developed (visualized), resulting in the formation of a toner image (developer image) on the surface of the photosensitive drum 101.

An intermediate transfer belt 107 including an endless belt as an intermediate transfer member is arranged so as to be opposed to the four cartridges P. The intermediate transfer belt 107 is stretched over a plurality of support rollers and is rotationally driven in the clockwise direction in FIG. 1. On the inner circumferential surface side of the intermediate transfer belt 107, primary transfer rollers 106Y, 106M, 106C, and 106K are arranged corresponding to respective photosensitive drums 101Y, 101M, 101C, and 101K, respectively. The primary transfer roller 106 is urged toward the photosensitive drum 101 via the intermediate transfer belt 107, resulting in the formation of a primary transfer part (primary transfer nip part) at which the photosensitive drum 101 and the intermediate transfer belt 107 come in contact with each other. The toner image formed on the photosensitive drum 101 is primarily transferred onto the intermediate transfer belt 107 at the primary transfer part. At the time of primary transfer, the primary transfer roller 106 is applied with a primary transfer voltage of an opposite polarity (in the present Example, the positive polarity) to the normal charging polarity (the charging polarity for development) of the toner. For example, at the time of formation of a full color image, toner images in respective colors of yellow, magenta, cyan, and black formed on the respective photosensitive drums 101Y, 101M, 101C, and 101K, respectively are successively primarily transferred in such a manner as to be superposed on the intermediate transfer belt 107.

On the other hand, the recording mediums S are separated into individual one sheet and fed by the feeding part 111 in synchronization with the formation of a toner image. On the outer circumferential surface side of the intermediate transfer belt 107, a secondary transfer roller 108 is arranged opposed to one of the plurality of support rollers of the intermediate transfer belt 107. The secondary transfer roller 108 is urged toward the opposing support roller via the intermediate transfer belt 107, resulting in the formation of a secondary transfer part (secondary transfer nip part) at which the intermediate transfer belt 107 and the secondary transfer roller 108 come in contact with each other. The recording medium S fed by the feeding part 111 is transported to the secondary transfer part and is passed through the secondary transfer part. The toner image formed on the intermediate transfer belt 107 is secondarily transferred onto the recording medium S at the secondary transfer part. At the time of secondary transfer, the secondary transfer roller 108 is applied with a secondary transfer voltage of an opposite polarity (in the present Example, the positive polarity) to the normal charging polarity (charging polarity for development) of the toner.

The recording medium S onto which a toner image has been transferred is transported to the fixing apparatus 109. The fixing apparatus 109 applies the recording medium S carrying an unfixed toner image with a heat and a pressure, thereby fixing (melting, fixing) the toner image on the recording medium S. As a result of this, an image is formed on the recording medium S. Subsequently, the recording medium S is transported by a discharge roller 112, or the like, and to be discharged (outputted) to a discharge part 113.

Further, the toner (primary residual toner) left on the surface of the photosensitive drum 101 after transfer of the toner image onto the intermediate transfer belt 107 is removed from the surface of the photosensitive drum 101 by the cleaning blade 105 and is collected into the cleaning frame body 151. As a result of this, the surface of the photosensitive drum 101 is cleaned. Then, the surface of the photosensitive drum 101 is uniformly subjected to a charging treatment by the charging roller 102 again. This enables the formation of an image. Further, the toner (secondary residual toner) left on the surface of the intermediate transfer belt 107 after transfer of the toner image onto the recording medium S is removed from the surface of the intermediate transfer belt 107 by an intermediate transfer member cleaning means (not shown) and is collected.

2. Half Score

Figure 3:
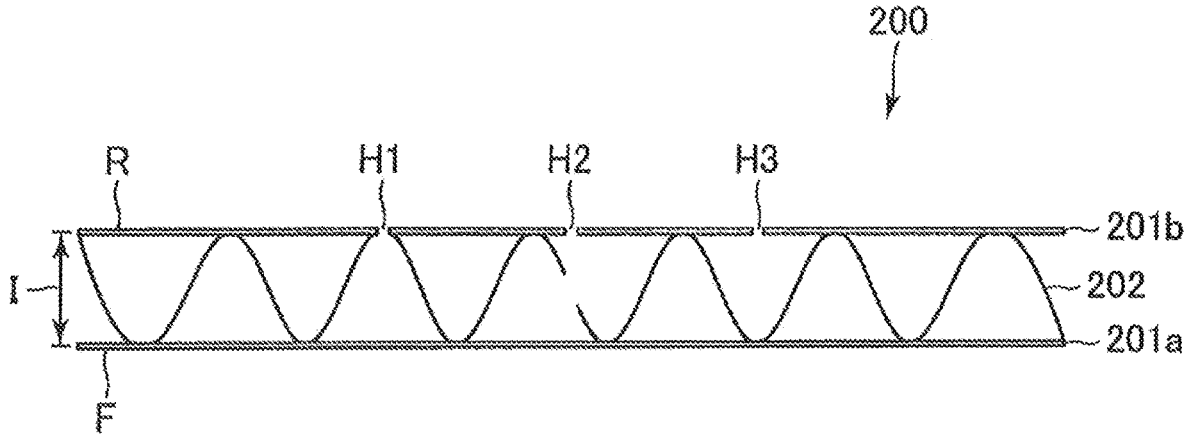
FIG. 3 is a schematic cross-sectional view of corrugated paper for illustrating a half score.

Referring to FIG. 3, a "half score" of the score provided in the packing box will be described. FIG. 3 is a schematic cross sectional view showing a cross section substantially orthogonal to the planar direction of a double-sided corrugated paper 200 as one example of corrugated paper. In the present Example, the packing box is formed using the double-sided corrugated paper 200 as corrugated paper.

The surface of corrugated paper facing the outside of the packing box (herein, which is also referred to as the "outside") with the packing box assembled is referred to as a corrugated paper front surface F. Whereas the surface of corrugated paper facing the inside of the packing box (herein, which is also referred to as the "inside") with the packing box assembled is referred to as a corrugated paper rear surface R. Further, the portion between the corrugated paper front surface F and the corrugated paper rear surface R is referred to as a corrugated paper intermediate layer I. In the case of the double-sided corrugated paper 200 as shown in FIG. 3, the corrugated paper front surface F is formed with the outer surface of the outer liner (cardboard) 201*a*. Whereas, in the case of the double-sided corrugated paper 200, the corrugated paper rear surface R is formed with the inner surface of the inner liner 201*b*. Further, in the case of the double-sided corrugated paper 200, the corrugated paper intermediate layer I between the outer liner 201*a* and the inner liner 201*b* includes the portion inside the corrugated paper front surface F of the outer liner 201*a*, and the portion outside the corrugated paper rear surface R of the inner liner 201*b*. Further, the intermediate layer I is arranged between the inner surface of the outer liner 201*a* and the outer surface of the inner liner 201*b* and includes a corrugated medium (corrugated cardboard) 202 including ridges and grooves continuously half-arrayed therein.

Then, the "half score" represents a score made from the corrugated paper rear surface R, and stopping without penetrating through to the corrugated paper front surface F opposite to the corrugated paper rear surface R. For the "half score," it does not matter whether or not there is a score into the corrugated medium 202 arranged in the corrugated paper intermediate layer I and how deep the score is as with half scores H1, H2, and H3 shown in FIG. 3. However, the "half score" typically penetrates through the inner liner 201*b*. In this case, it becomes easier to cause peeling of the intermediate layer I of corrugated paper involving rupture of the corrugated medium 202 due to the opening operation described later, which makes it easier to clearly leave a trace of opening of the packing box.

Figure 14:
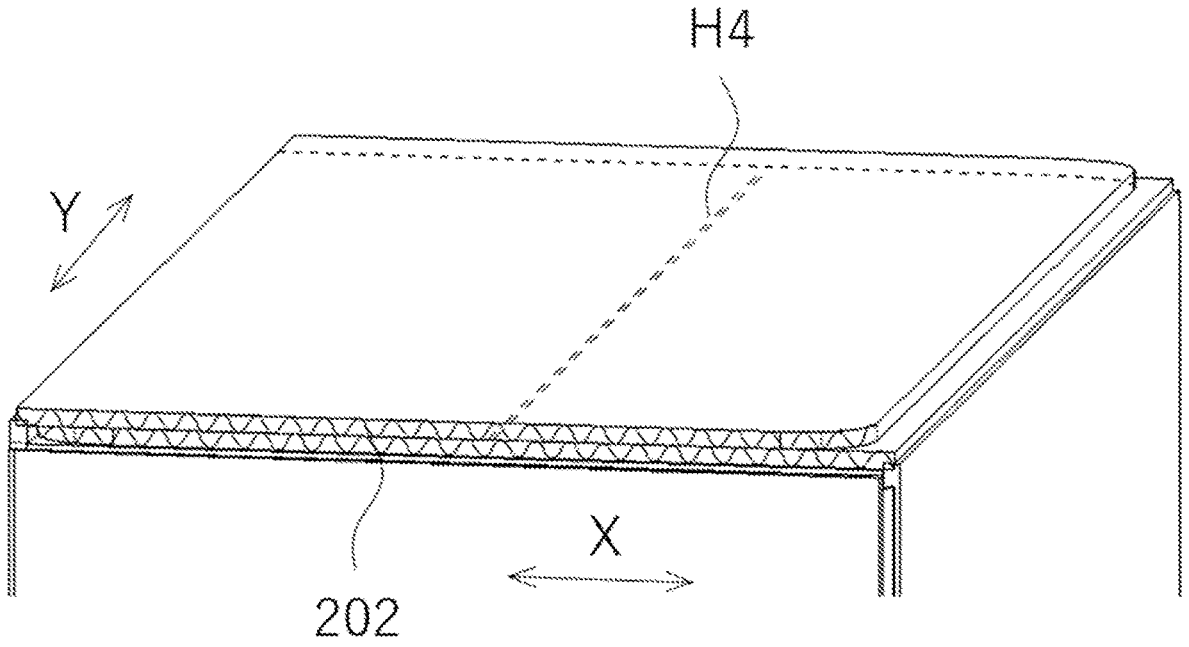
FIG. 14 is a perspective view schematically showing the direction in which a half score of corrugated paper is made.

FIG. 14 is a perspective view schematically showing the direction in which the half score is made with respect to the array of the corrugated medium of the corrugated paper. In FIG. 14, the direction in parallel with the array direction of the ridges and grooves of the corrugated medium 202 is indicated with an X direction, and the direction orthogonal to the array direction of the ridges and grooves of the corrugated medium 202 is indicated with a Y direction. By making half scores in the Y direction as with the half scores H4, it is possible to reduce cutting in the direction in parallel with the array direction of the ridges and grooves of the corrugated medium of the corrugated paper, which can reduce buckling of the corrugated medium due to compression described later.

Figure 15A:
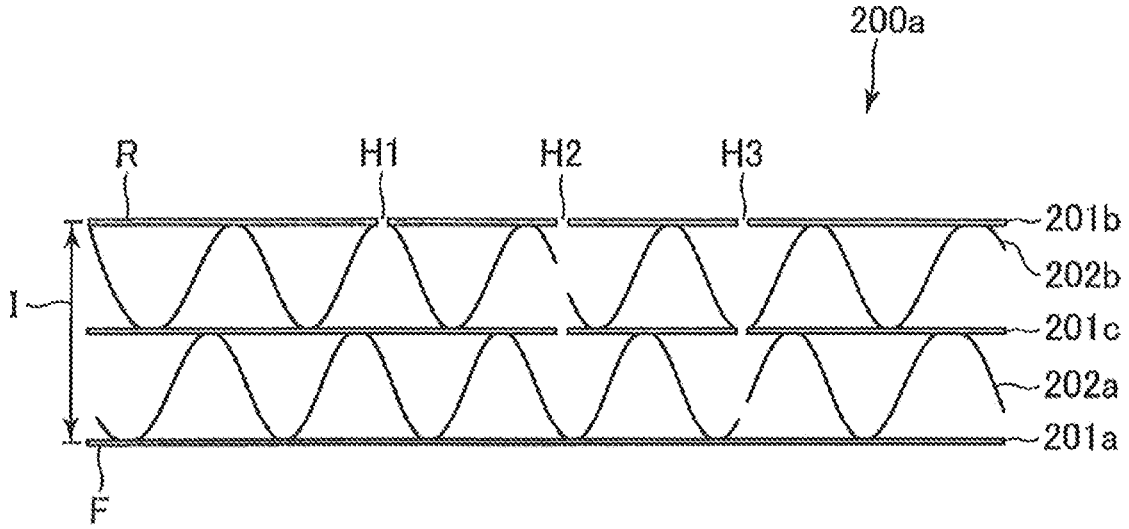
FIGS. 15A and 15B are each a schematic cross-sectional view showing another example of corrugated paper.
Figure 15B:
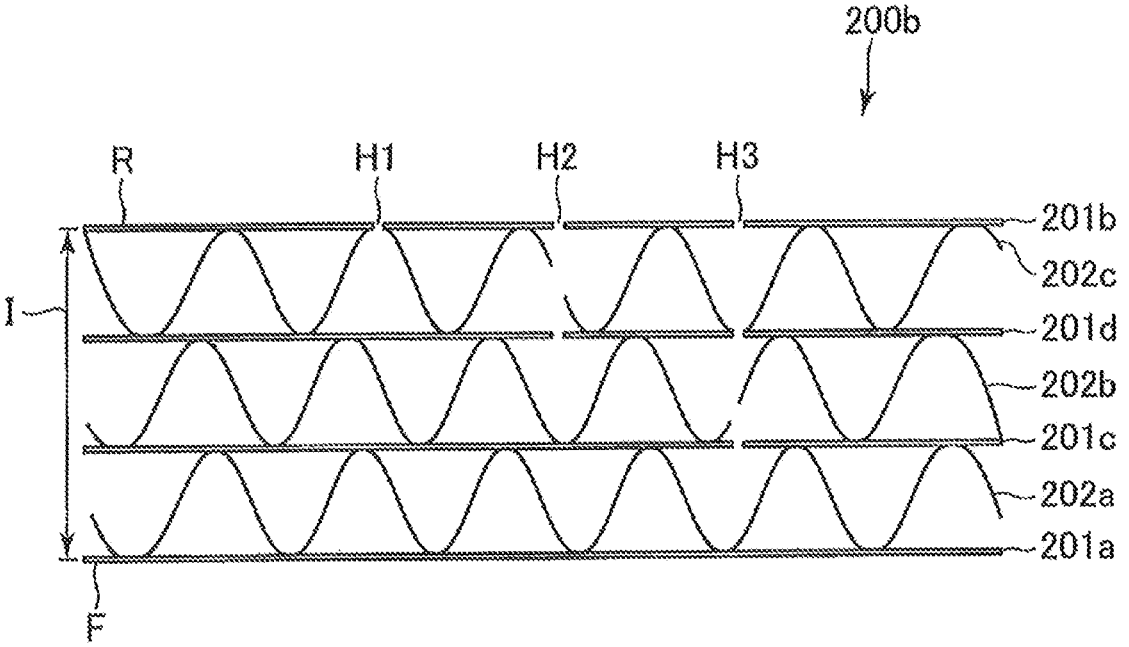

Herein, the corrugated paper is not limited to the double-sided corrugated paper 200 as shown in FIG. 3. The corrugated paper may be multilayer corrugated paper with a configuration in which one-side corrugated papers are successively stacked on double-sided corrugated paper such as double double-sided corrugated paper (two-layer corrugated paper) 200*a* as shown in FIG. 15A, redouble double-sided corrugated paper (three-layer corrugated paper) 200*b* as shown in FIG. 15B. In the case of the multilayer corrugated paper, the corrugated paper front surface F is formed of the outer surface of the outermost liner 201*a*. Whereas, in the case of the multilayer corrugated paper, the corrugated paper rear surface R is formed of the inner surface of the innermost liner 201*b*. Whereas, in the case of the multilayer corrugated paper, the corrugated paper intermediate layer I includes the whole such as the liner or the corrugated medium between the corrugated paper front surface F and the corrugated paper rear surface R. Then, also in the case of the multilayer corrugated paper, the definition of the "half score" is the same as the foregoing, and represents a score to be made from the corrugated paper rear surface R, and to stop without penetrating through to the corrugated paper front surface F. For the "half score", it does not matter whether or not there is a score into corrugated medium (202*a*, 202*b*, or 202*c*), and other liners (201*c* and 201*d*) than the outermost and innermost liners 201*a* and 201*b* arranged at the corrugated paper intermediate layer I, and how deep the score is. However, the "half score" typically penetrates through the innermost liner 201*b* or penetrates through single or a plurality of liners (201*b*, 201*c*, and 201*d*) except for the outermost liner 201*a*. In this case, it becomes easier to cause peeling of the intermediate layer I of corrugated paper involving rupture of the corrugated mediums 202*a*, 202*b*, and 202*c* due to the opening operation describe later, which makes it easier to clearly leave a trace of opening of the packing box.

Incidentally, as distinct from the "half score", the score penetrating through from the corrugated paper rear surface R to the corrugated paper front surface F (or from the corrugated paper front surface F to the corrugated paper rear surface R) is also referred to as a "through score".

3. Configuration of Packing Box

Figure 4:
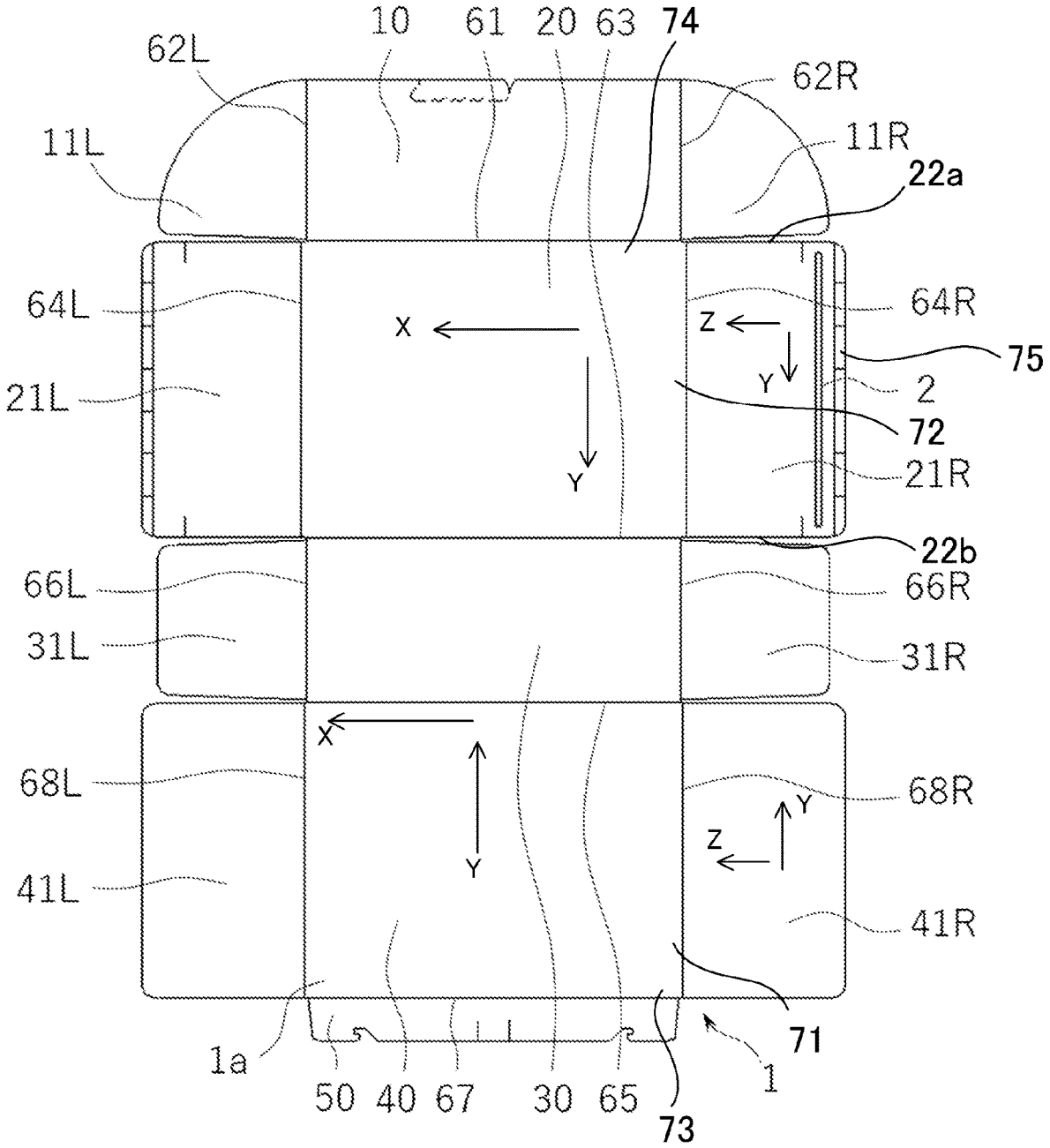
FIG. 4 is a plan view of a state of a packing box before assembly.

Referring to FIG. 4, the overall configuration of a packing box 1 of the present Example will be described. FIG. 4 is a plan view of the packing box 1 of the present Example in a spread flat plate (pattern) before assembly as seen from the inside direction thereof. The cartridge P as the object to be packed is housed in the inside of the packing box 1 of the present Example at the time of transport. The packing box 1 is formed of corrugated paper having a corrugated medium including a plurality of ridges and grooves arrayed in the array direction therein.

The packing box 1 has a top surface plate 10, a rear surface plate 20, a bottom surface plate 30, a front surface plate 40, and a joint plate 50. The top surface plate 10 and the rear surface plate 20 are connected with each other via a hinge part (a folding part or a bending part) 61. The rear surface plate 20 and the bottom surface plate 30 are connected with each other via a hinge part 63. The bottom surface plate 30 and the front surface plate 40 are connected with each other via a hinge part 65. The front surface plate 40 and the joint plate 50 are connected with each other via a hinge part 67.

Further, the top surface plate 10 is connected with a right inner top flap 11R and a left inner top flap 11L via hinge parts 62R and 62L, respectively. Further, the rear surface plate 20 is connected with a right outer rear flap 21R and a left outer rear flap 21L via hinge parts 64R and 64L, respectively. The bottom surface plate 30 is connected with a right inner bottom flap 31R and a left inner bottom flap 31L via hinge parts 66R and 66L, respectively. Further, the front surface plate 40 is connected with a right inner front flap 41R and a left inner front flap 41L via hinge parts 68R and 68L in the Y direction, respectively.

For the packing box 1, a box body is formed which is obtained by bending the top surface plate 10, the rear surface plate 20, the bottom surface plate 30, the front surface plate 40, and the joint plate 50 from the state of a flat plate shown in FIG. 4 and forming a tubular body substantially rectangular in cross section in the present Example. The top surface plate 10, the rear surface plate 20, the bottom surface plate 30, the front surface plate 40, and the joint plate 50 configure the surrounding wall of the box body 1*a* (see FIG. 5). Then, a second opening 1*c* (see FIG. 6) formed on the right side and the left side of the box body 1*a* in FIG. 4 is closed by bending the flaps provided at the top surface plate 10, the rear surface plate 20, the bottom surface plate 30, and the front surface plate 40, respectively. The cartridge P as an object to be packed is housed in the space inside the closed box body 1*a*. For assembly of the packing box 1, appropriately, an adhesion member such as an adhesive as a fixing means is used. In the present Example, a hotmelt adhesive of an adhesive as an adhesion member is used. However, the adhesion member is not limited to a hotmelt adhesive and given usable adhesive and sticker can be used. For example, a double-sided tape may be used.

Figure 5:
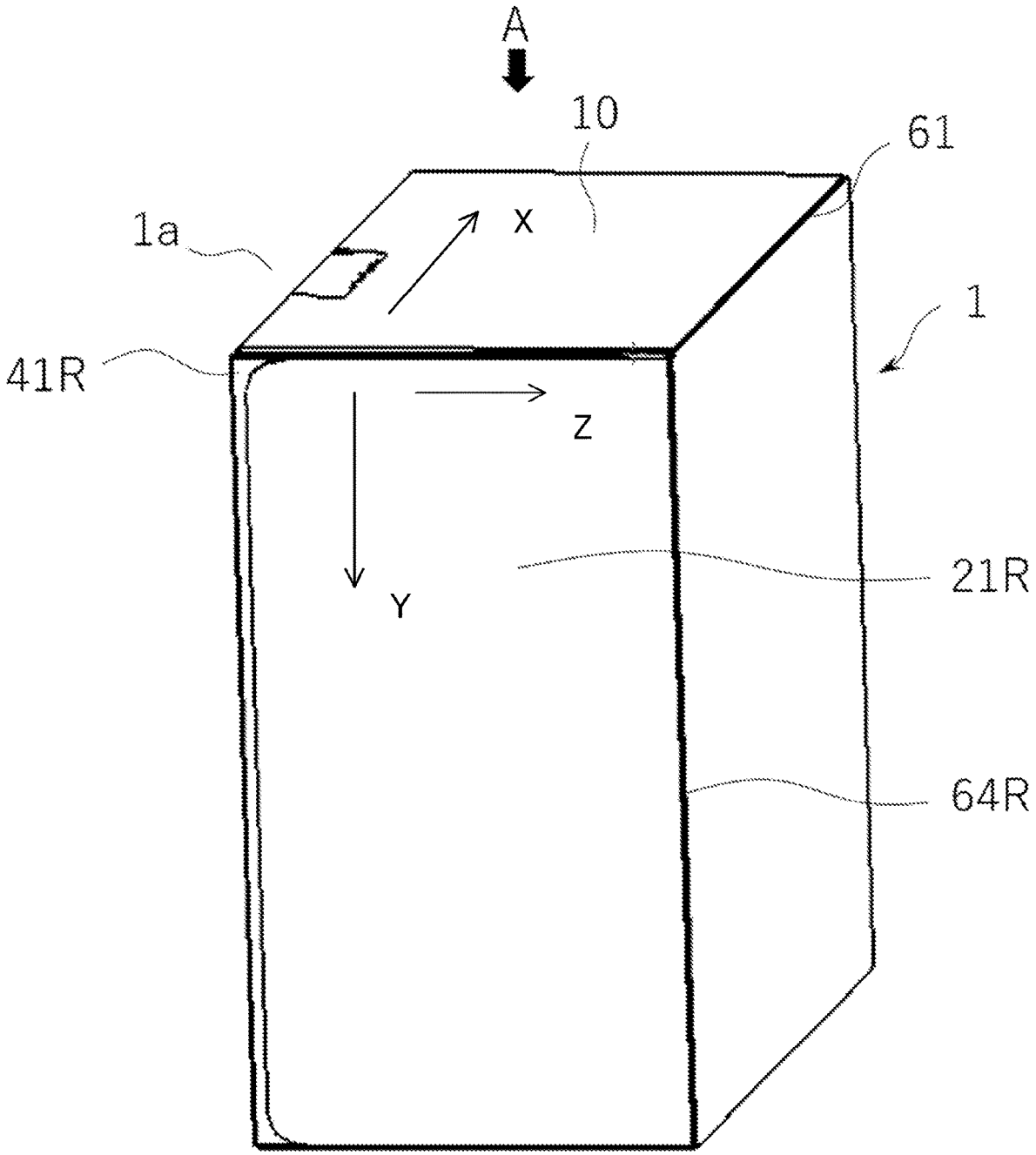
FIG. 5 is a perspective view of a packing box after assembly.

Referring to FIGS. 4 and 5, an assembly method of the packing box 1 of the present Example will be further described. FIG. 5 is a perspective view of the packing box 1 in an assembled state of the present Example as seen from the right outer rear flap 21R side.

First, from the state of the flat plate shown in FIG. 4, the top surface plate 10, the rear surface plate 20, the bottom surface plate 30, the front surface plate 40, and the joint plate 50 are bent inward at substantially right angels at the hinge parts 61, 63, 65, and 67, respectively. The stacked top surface plate 10 and joint plate 50 are bonded with each other by a hotmelt adhesive. Incidentally, in the present Example, the top surface plate 10 and the joint plate 50 are stacked so that the joint plate 50 is arranged on the inner side, and so that the top surface plate 10 is arranged on the outer side. Then, the right inner top flap 11R, the right inner bottom flap 31R, the left inner top flap 11L, and the left inner bottom flap 31L are bent inward at substantially right angles at the hinge parts 62R, 66R, 62L, and 66L, respectively. Then, the right inner front flap 41R and the left inner front flap 41L are bent inward at substantially right angles at the hinge parts 68R and 68L, respectively. Subsequently, the right outer rear flap 21R and the left outer rear flap 21L are bent inward at substantially right angles at the hinge parts 64R and 64L, respectively. Then, adhesion is established between the right outer rear flap 21R and the right inner front flap 41R stacked one on another, and between the left outer rear flap 21L and the left inner front flap 41L stacked one on another by an adhesive 2. FIG. 5 shows a state of the packing box 1 assembled with the right outer rear flap 21R closed and bonded to the right inner front flap 41R.

In the packing box 1 assembled in this manner, the front surface plate 40 configures a first side part extending in a first direction (X direction) and a second direction (Y direction) intersecting the first direction. Herein, the first direction (X direction) and the second direction (Y direction) are the directions defined for the packing box 1 having been assembled of FIG. 5 and may vary in orientation according to the surface even in a case where they are, for example, the same second direction (Y direction) on the development of FIG. 4.

The front surface plate 40 as the first side part has a first edge portion 71 at the edge in the first direction (X direction) and extending in the second direction (Y direction). The rear surface plate 20 configures a second side part opposed to the first side part (front surface plate 40) and extending in the first direction (X direction) and the second direction (Y direction).

The rear surface plate 20 as the second side part has a second edge portion 72 situated on the same side as the first edge portion 71 in the first direction (X direction) and extending in the second direction (Y direction).

The packing box 1 has a first opening 1*b* (see FIG. 9) with the right inner front flap 41R of a first inner lid part and the right outer rear flap 21R of a first outer lid part being unbonded. The first opening 1*b* is an opening surrounded by the first edge portion 71 of the first side part (front surface plate 40), and the second edge portion 72 of the second side part (rear surface plate 20) and formed at one side part of the box body 1*a* capable of housing an object to be packed.

The right inner front flap 41R is a first inner lid part provided in such a manner as to be bent along the hinge part 68R of a first bending line extending in the second direction (Y direction) relative to the first edge portion 71 of the first side part (front surface plate 40). The first inner lid part (right inner front flap 41R) is configured so as to extend in the second direction (Y direction), and the third direction (Z direction) intersecting the first direction (X direction) and the second direction (Y direction), and to close at least a part of the first opening 1*b*.

The right outer rear flap 21R is a first outer lid part provided so as to be bent along the hinge part 64R of the second bending line extending in the second direction (Y direction) relative to the second edge portion 72 of the second side part (rear surface plate 20). The first outer lid part (right outer rear flap 21R) extends in the second direction (Y direction) and the third direction (Z direction), and the inner surface thereof is externally stacked on at least a part of the outer surface of the first inner lid part (right inner front flap 41R). The first outer lid part (right outer rear flap 21R) is configured such that the array direction of the corrugated medium of the corrugated paper configuring the packing box 1 may become the third direction (Z direction). A more particular configuration of the right outer rear flap 21R, and the like will be described later.

An adhesion part 2*a* (see FIG. 9) formed of the adhesive 2 bonds the inner surface of the first outer lid part (right outer rear flap 21R) and the outer surface of the first inner lid part (right inner front flap 41R).

Incidentally, the form of the packing box 1 of the present Example is one example, and the present invention is not limited to this form. For example, the number of surfaces of the surrounding wall forming the box body 1*a* is not limited to 4 and may be 3 or 5 or more. The number can be appropriately selected so as to conform to an object to be packed.

4. Genuine Opening

In the present Example, the packing box 1 is configured so as to be able to be suppressed from being reassembled after opening and disguised as being unopened by leaving a trace of fraudulent opening. As a result of this, it is possible to suppress the quality reduction of the cartridge P, and the packing box 1 opened in a fraudulent manner from being reused for selling a fraudulent cartridge as a genuine product. In the present Example, as the form of fraudulent opening of the packing box 1, it is assumed that the packing box 1 is opened for taking out the cartridge P from a site other than the site configured as the genuine opening site by the manufacturer of the genuine product.

Figure 6:
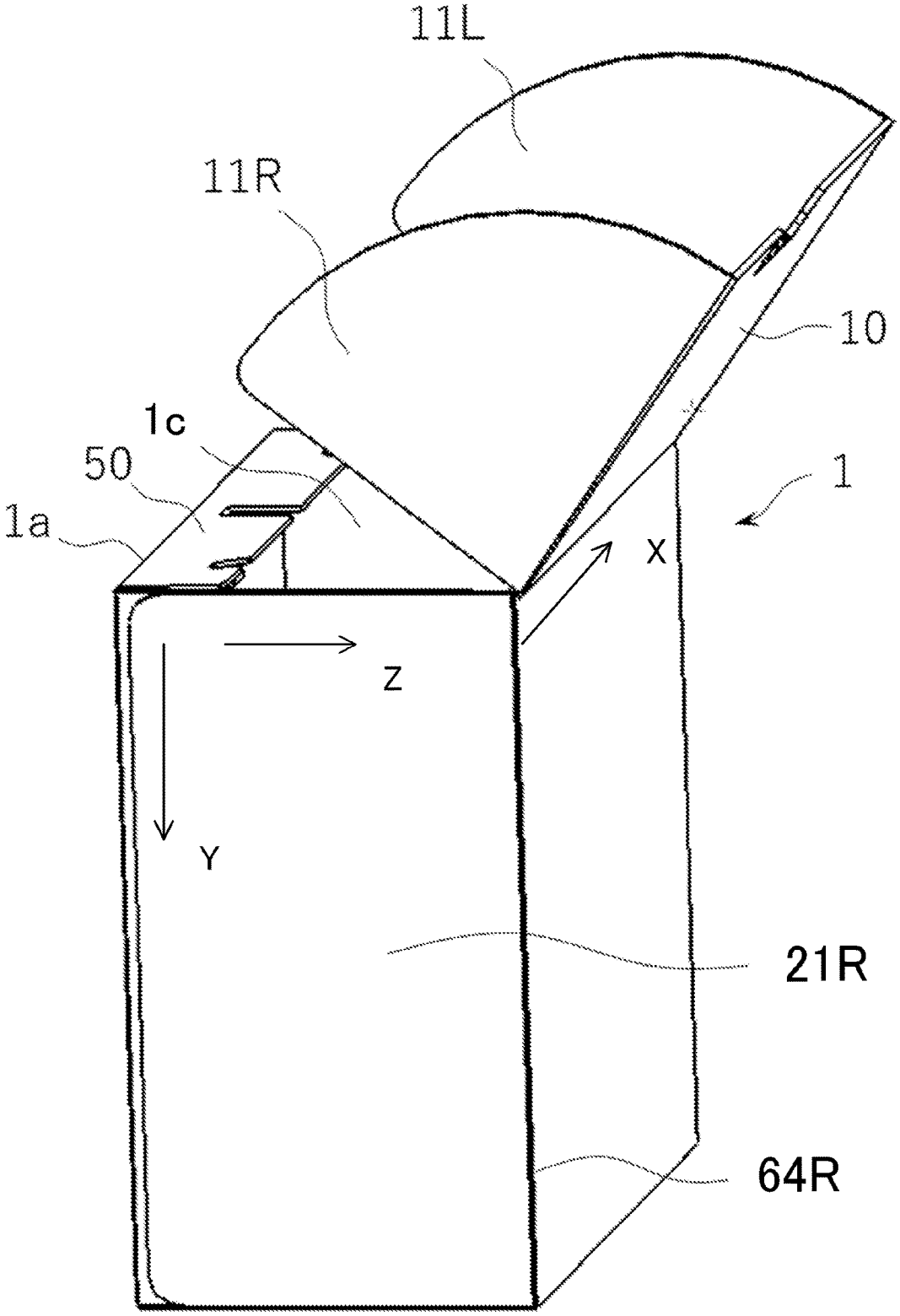
FIG. 6 is a perspective view of a packing boxy for illustrating a genuine opening operation of the packing box.

First, a description will be given to genuine opening of the packing box 1 of the present Example. FIG. 6 is a perspective view of the packing box 1 opened by raising up the top surface plate 10 from the assembled state shown in FIG. 5 as seen from the right outer rear flap 21R side.

In the present Example, the packing box 1 is configured with the top surface plate 10 (second outer lid) as a genuine opening site. In other words, in the present Example, the cartridge P as an object to be packed can be taken out from the second opening 1*c* to be opened by raising up the top surface plate 10, and further raising up the joint plate 50 (second inner lid) onto which the top surface plate 10 has been stacked and bonded as shown in FIG. 6.

Particularly, the first side part (front surface plate 40) has a third edge portion 73 situated at the edge in the second direction (Y direction) and extending in the first direction (X direction). Whereas the second side part (rear surface plate 20) has a fourth edge portion 74 situated on the same side as the third edge portion 73 in the second direction (Y direction) and extending in the first direction (X direction). The packing box 1 has a second opening 1*c* surrounded by the third edge portion 73 and the fourth edge portion 74 with the top surface plate 10 and the joint plate 50 unbonded to each other.

The joint plate 50 is a second inner lid part provided so as to be bent along the hinge part 67 of a third bending line extending in the first direction (X direction) relative to the third edge portion 73 of the first side part (front surface plate 40). The second inner lid part (joint plate 50) extends in the first direction (X direction) and the third direction (Z direction) and is configured so as to close at least a part of the second opening 1*c*.

The top surface plate 10 is a second outer lid part provided so as to be bent along the hinge part 61 of a fourth bending line extending in the first direction (X direction) relative to the fourth edge portion 74 of the second side part (rear surface plate 20). The second outer lid part (top surface plate 10) extends in the first direction (X direction) and the third direction (Z direction), and the inner surface thereof is externally stacked on at least a part of the outer surface of the second inner lid part (joint plate 50).

Figure 7A:
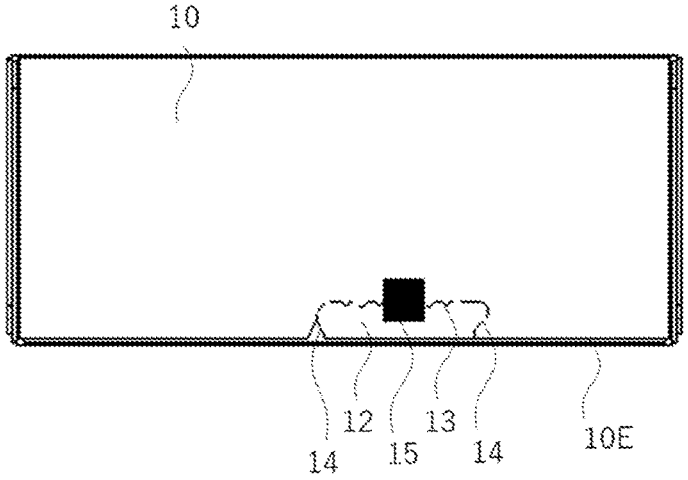
FIGS. 7A to 7C are each a side view of the genuine opening site for illustrating the genuine opening operation of the packing box.
Figure 13:
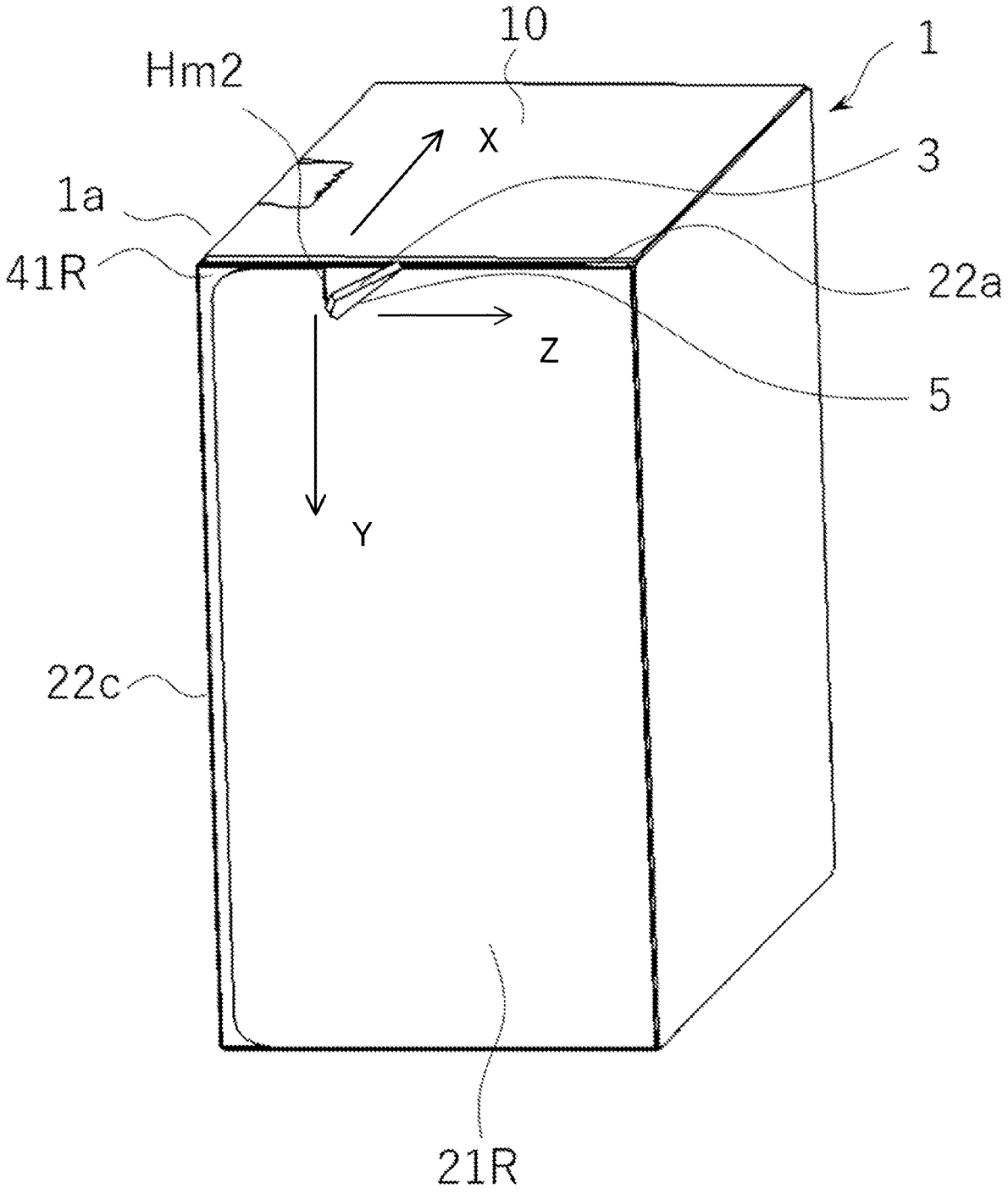
FIG. 13 is a schematic perspective view for illustrating the fraudulent opening operation of the packing box.

Further, as shown in FIG. 7A, the top surface plate 10 is provided with an opening band 12 formed of a perforation line by through scores. The opening band 12 is formed of a rupture FIG. 13 provided in parallel with an external side 10E, and a rupture FIG. 14 extending toward the rupture FIG. 13 with the external side 10E as the edge, arranged on the top surface plate 10. The rupture FIG. 13 is a rupture figure in a perforation line shape including through scores and discontinuous parts not provided with a through score provided alternately therein. The rupture FIG. 14 is formed of a rupture figure in a perforation line shape including through scores and discontinuous parts not provided with a through score, provided alternately therein. Herein, the perforation line is a line formed by alternately repeating through scores and discontinuous parts without through scores, and only needs to guide the rupture part of the opening band 12 by the genuine opening operation described later.

Figure 7B:
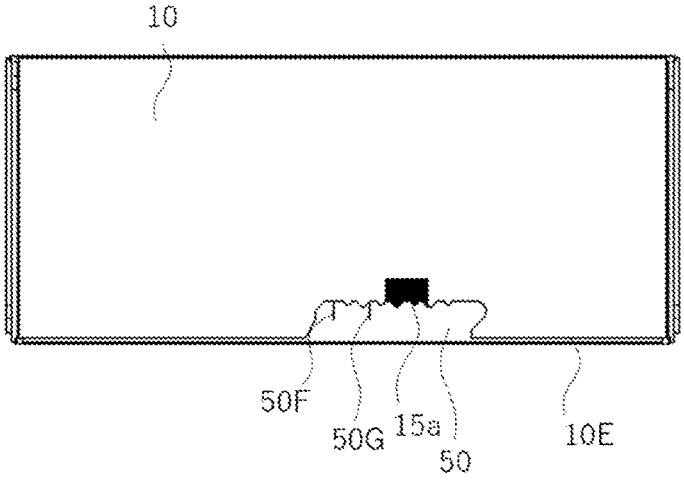
Figure 7C:
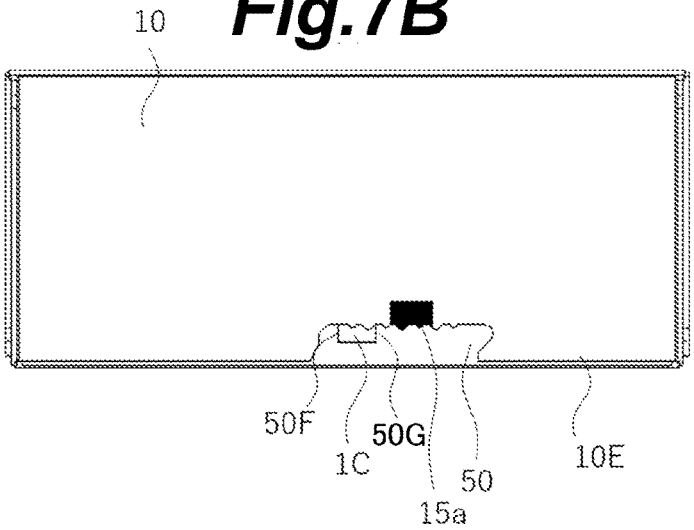

In a case where the opening band 12 is removed in such a manner as to be raised up from one edge in the longitudinal direction as shown in FIG. 7B, it is found that the joint plate 50 has a through score 50F and a through score 50G. As shown in FIG. 7C, by pushing the joint plate 50 between 50F and 50G, an opening 1C is formed, which facilitates insertion of a hand. Accordingly, it becomes possible to grasp the top surface plate 10 from the side of the inside of the packing box 1, so that the top surface plate 10 becomes more likely to be raised up. By raising up the top surface plate 10 and the joint plate 50, it is possible to take out the cartridge P.

In the present Example, onto the external surface of the top surface plate 10, a tamper-proof seal 15 of a seal is stuck in such a manner as to be across the opening band 12 (particularly, in the present Example, the rupture FIG. 13). As a result of this, the second outer lid part (top surface plate 10) is sealed. In the present Example, as the tamper-proof seal 15, the one to be easily ruptured in a case where the opening band 12 is ruptured by a genuine opening operation described later is used. As the tamper-proof seal 15, a known one whose adhesion surface will not be easily peeled and will be easily ruptured when applied with a force in a direction crossing the adhesion surface and will become difficult to restore can be used.

Thus, for the packing box 1 of the present Example, in a case where the genuine opening operation of the top surface plate 10 of the genuine opening site is performed, the opening band 12 is ruptured, and further, the tamper-proof seal 15 is ruptured. The tamper-proof seal 15 is difficult to restore when once ruptured. In a case where the tamper-proof seal 15 is peeled, the corrugated paper front surface F configuring the external surface of the top surface plate 10 is peeled off, or other phenomena are caused, leaving a trace thereof. As a result of this, the packing box 1 of the present Example is configured to leave a trace of the genuine opening operation. Incidentally, in FIG. 7B, the rupture part of a rupture seal strip 15*a* is drawn in the same shape as that of the opening band 12. However, the present invention is not limited thereto. For example, rupture in a straight-line shape, or the like is also acceptable.

Figure 8A:
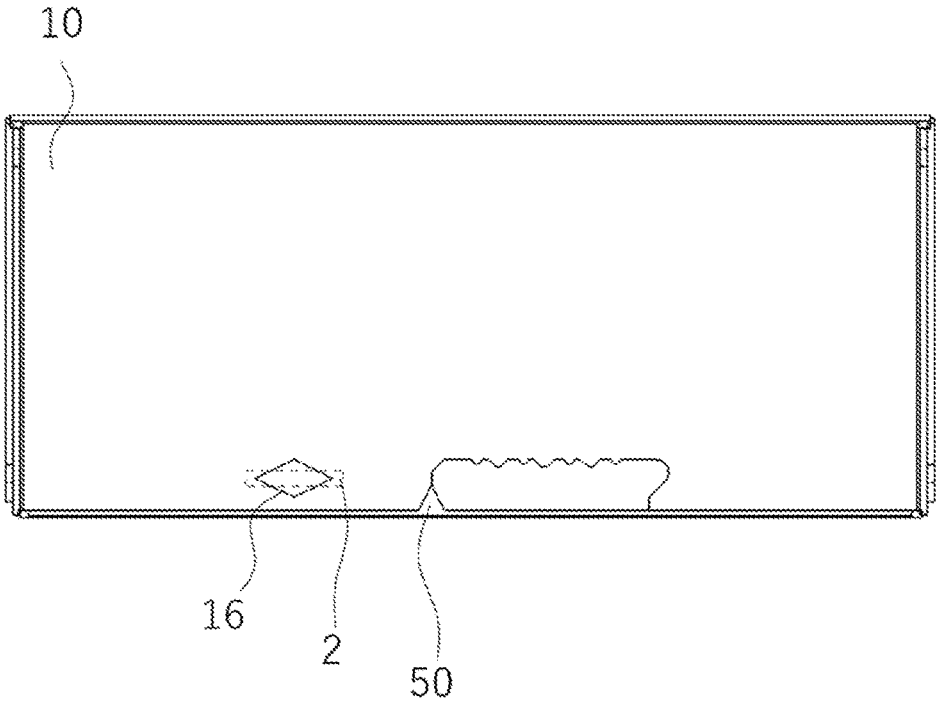
FIGS. 8A and 8B are each a schematic view for illustrating another example of the opening operation of the genuine opening site.
Figure 8B:
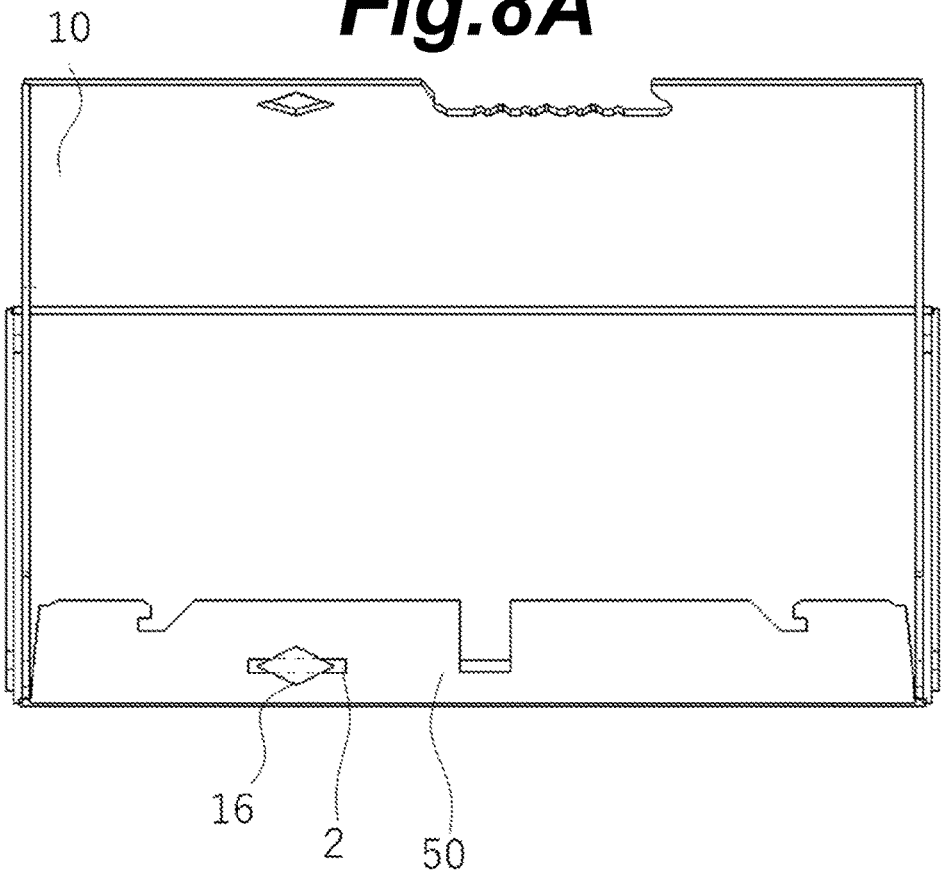
Figure 16:
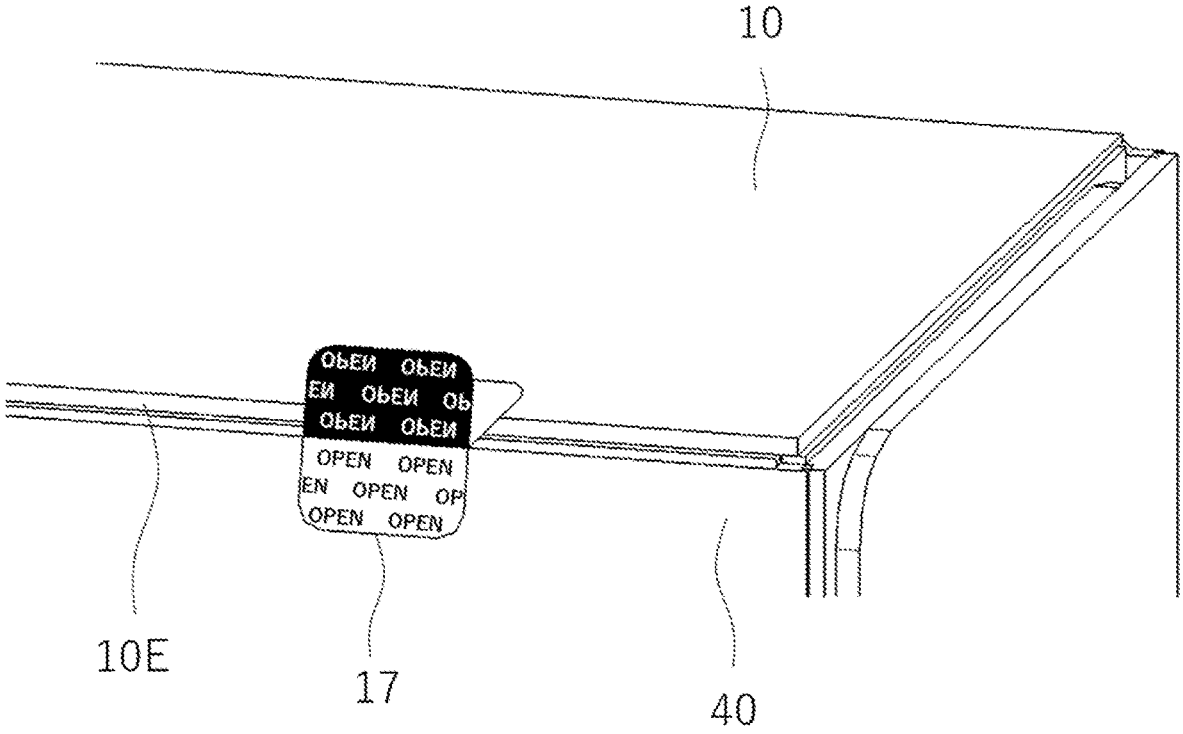
FIG. 16 is a schematic view for illustrating another example of the opening operation of the genuine opening site.

Herein, the configuration for leaving a trace of the genuine opening operation is not limited to the configuration of the present Example. FIGS. 8A and 8B are each a schematic view showing another example of the configuration for leaving a trace of the genuine opening operation. For example, the configuration is also acceptable in which in place of, or in addition to the opening band, as shown in FIG. 8A, the top surface plate 10 is provided with a rupture FIG. 16 and is fixed with the joint plate 50 by the adhesive 2. The rupture FIG. 16 is a rupture figure in a perforation line shape including through scores and discontinuous parts not provided with a through score alternately provided therein. As a result of this, as shown in FIG. 8B, the opening operation of raising up the top surface plate 10 leaves the rupture FIG. 16 at the joint plate 50, which can leave a trace of the opening operation.

Alternatively, the configuration using a known tamper-proof seal 17 is also acceptable in which peeling as shown in FIG. 16 results in appearance (leaving on the joining surface without peeling) of letters of "OPEN" or the like.

5. Configuration of Right Outer Rear Flap

Then, a description will be given to the configuration for leaving a trace of fraudulent opening of the packing box 1 in the present Example (herein, which will be also simply referred to as "a trace of opening"). As described above, the packing box 1 of the present Example is configured such that in a case where the genuine opening operation of the top surface plate 10 of the genuine opening site is performed, a trace of the genuine opening operation is left. For this reason, it is assumed as follows: for example, in a case where the packing box 1 is tried to be opened fraudulently in order to reuse the packing box 1, or for other purposes, the right outer rear flap 21R of the first outer lid part is tried to be opened as a site other than the genuine opening site. Thus, in the present Example, the right outer rear flap 21R is provided with a configuration for leaving a trace of fraudulent opening of the packing box 1.

Figure 9:
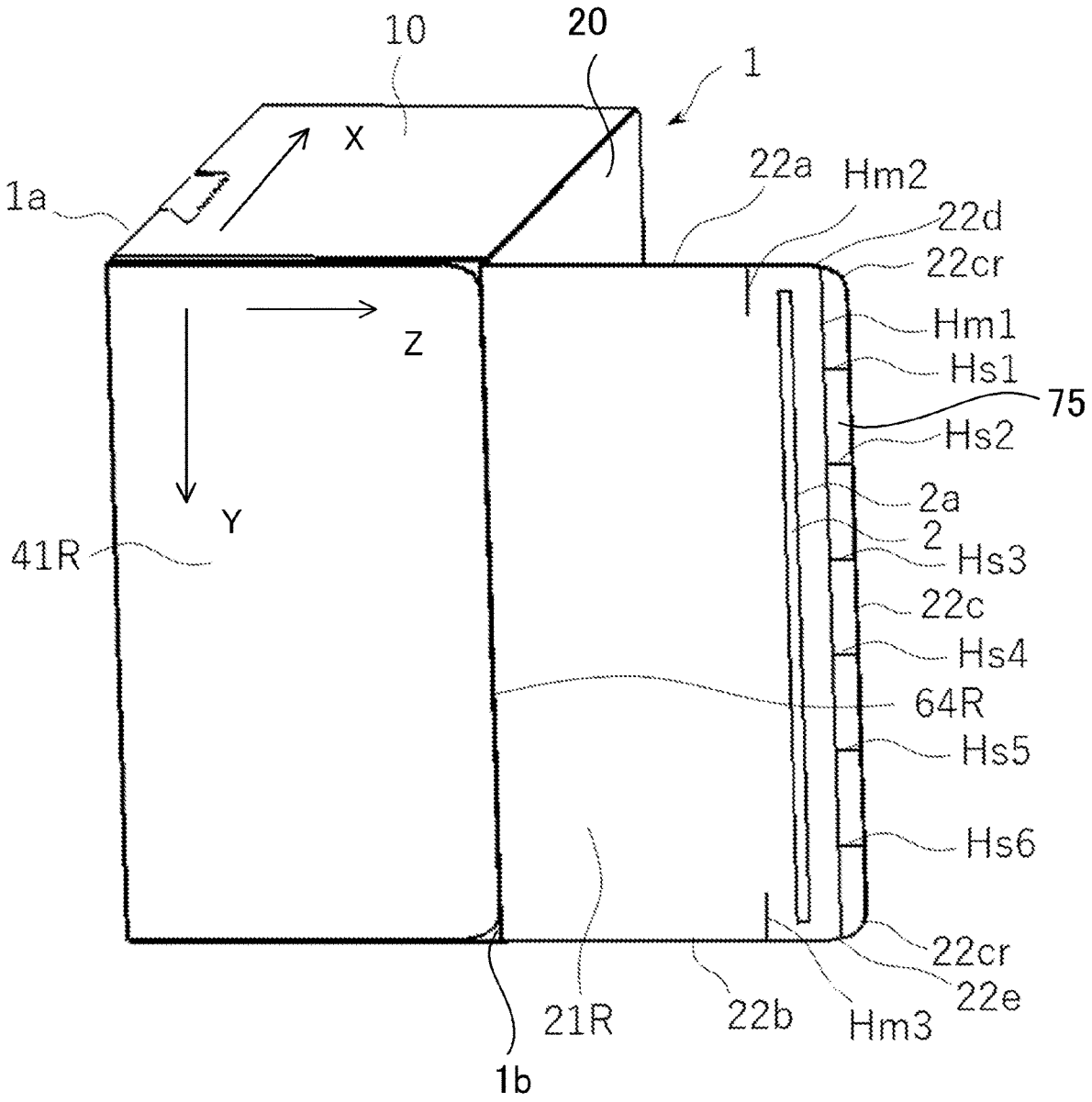
FIG. 9 is a perspective view of the packing box during assembly.

FIG. 9 is a perspective view of the packing box 1 of the present Example before closing of the right outer rear flap 21R as seen from the right outer rear flap 21R side. The right outer rear flap 21R has a first side 22*c* extending in the direction (Y direction) along the hinge part 64R, a second side 22*a* extending from one edge of the first side 22*c* toward the hinge part 64R, and a third side 22*b* extending from the other edge of the first side 22*c* toward the hinge part 64R. The second side 22*a* is a first end of the first outer lid part (right outer rear flap 21R) in the second direction (Y direction), and the third side 22*b* is a second end of the first outer lid part (right outer rear flap 21R) in the second direction (Y direction). The second side 22*a* and the third side 22*b* extend in parallel with each other in the third direction (Z direction). The first side 22*c* extends in parallel with the hinge part 64R in the second direction (Y direction). In the present Example, the edge in the Y direction of the first side 22*c* includes a curve part 22*cr*. The edge on the first side 22*c* side of the second side 22*a* becomes an inclined side 22*d* connected with the curve part 22*cr*, and the edge on the first side 22*c* side of the third side 22*b* becomes an inclined side 22*e* connected with the curve part 22*cr*.

At the right outer rear flap 21R of the first outer lid part, main half scores (Hm1, Hm2, and Hm3) and sub-half scores (Hs1, Hs2, Hs3, Hs4, Hs5, and Hs6) are formed by the "half scores". The main half scores Hm and the sub-half scores Hs guide peeling of the intermediate layer I of corrugated paper by an opening operation described later, or the like.

The inner surface of the right outer rear flap 21R opposed to the right inner front flap 41R is provided with an adhesion part 2*a* extending in the Y direction along the first side 22*c*, and for bonding the right outer rear flap 21R and the right inner front flap 41R by the adhesive 2. The adhesion part 2*a* is elongated in the Y direction. As the adhesive 2, for example, a hotmelt adhesive can be used.

The inner surface of the right outer rear flap 21R of the first outer lid part is provided with a first score part between an edge 75 opposite to the hinge part 64R of the second bending line in the third direction (Z direction) and the adhesion part 2*a*. The first score part has a first main half score Hm1 (first score) provided along the second direction (Y direction). The first main half score Hm1 is formed of a half score not reaching the outer surface opposed to the inner surface of the right outer rear flap 21R of the first outer lid part. The first main half score Hm1 is provided so as to extend from one end (first end) (the second side 22*a*) to the other end (the second end) (the third side 22*b*) in the second direction (Y direction) of the right outer rear flap 21R of the first outer lid part between the adhesion part 2*a* and the first side 22*c*. In the present Example, the first main half score Hm1 extends from the inclined side 22*d* of the second side 22*a* to the inclined side 22*e* of the third side 22*b*. The first main half score Hm1 and the adhesion part are adjacent to each other with prescribed spacing in the Z direction. The prescribed spacing can be appropriately set according to the size of the packing box 1, or the like, and is set at, for example, about 5 mm to 30 mm. The direction of extension of the first main half score Hm1 may only be along the direction orthogonal to the array direction of the ridges and grooves of the corrugated medium of the corrugated paper and is not strictly limited to the direction in parallel with the direction orthogonal to the array direction of the ridges and grooves of the corrugated medium.

The inner surface of the right outer rear flap 21R of the first outer lid part is provided with a second score part in the region on the side of the hinge part 64R of the second bending line relative to the adhesion part 2*a* in the third direction (Z direction). The second score part has a second main half score Hm2 of a second score formed of a half score. The second main half score Hm2 is provided so as to extend along the second direction (Y direction) from the first end (the second side 22*a*) toward the second end (the third side 22*b*) in the second direction (Y direction) of the right outer rear flap 21R of the first outer lid part. The second main half score Hm2 is provided in vicinity to the adhesion part 2*a* between the adhesion part 2*a* and the hinge part 64R.

Whereas, the inner surface of the right outer rear flap 21R of the first outer lid part is provided with a third score part in a region on the side of the hinge part 64R of the second bending line relative to the adhesion part 2*a* in the third direction (Z direction). The third score part has a third main half score Hm3 of a third score formed of a half score. The third main half score Hm3 is provided so as to extend along the second direction (Y direction) from the second end (the third side 22*b*) toward the first end (the second side 22*a*) in the second direction (Y direction) of the right outer rear flap 21R of the first outer lid part.

The second main half score Hm2 and the third main half score Hm3 are provided with prescribed spacing in the Z direction relative to the adhesion part 2*a*. The prescribed spacing can be appropriately set according to the size of the packing box 1, or the like, and is set at, for example, about 5 mm to 30 mm. Further, each length in the Y direction of the second main half score Hm2 and the third main half score Hm3 can be appropriately set according to the size of the packing box 1, or the like, and is set at, for example a length of more than about 5 mm. The direction of extension of the second main half score Hm2 and the third main half score Hm3 may only be along the direction orthogonal to the array direction of the ridges and grooves of the corrugated medium of the corrugated paper and is not strictly limited to the direction in parallel with the direction orthogonal to the array direction of the ridges and grooves of the corrugated medium.

With the foregoing configuration, the adhesion part 2*a* is situated between the first main half score Hm1, and the second main half score Hm2 and the third main half score Hm3.

Whereas, the inner surface of the right outer rear flap 21R of the first outer lid part is provided with at least one sub-half score Hs extending from the edge 75 opposite to the hinge part 64R of the second bending line toward the first main half score Hm1 of the first score part in the third direction (Z direction). The sub-half score Hs is a different score (fourth score) from the first main half score Hm1 of the first score, formed of a half score, in a region surrounded by the first side 22*c*, the second side 22*a*, the third side 22*b*, and the first main half score Hm1.

In the present Example, at least one sub-half score Hs is a plurality of sub-half scores Hs1, Hs2, Hs3, Hs4, Hs5, and Hs6 extending along the third direction (Z direction). In the present Example, the region where the sub-half score Hs is provided is the region surrounded by the first main half score Hm1, the inclined side 22*d*, the curve part 22*cr*, the first side 22*c*, and the inclined side 22*e*, and a region with a length in the Y direction shorter than the distance in the Y direction between the second side 22*a* and the third side 22*b*. The sub-half score Hs is formed of a plurality of half scores spaced along the second direction (Y direction) in this region.

Further, each sub-half score Hs extends from the first side 22*c* to the first main half score Hm1 in the Z direction. Namely, the edge on the first side 22*c* side of each sub-half score Hs is in contact with the first side 22*c*, and each sub-half score Hs extends from the first side 22*c* toward the first main half score Hm1. Furthermore, the edge on the first main half score Hm1 side of each sub-half score Hs is in contact with the first main half score Hm1, and each sub-half score Hs extends from the first main half score Hm1 toward the first side 22*c*.

Incidentally, each sub-half score Hs may extend from the position separated from the first side 22*c* toward the first main half score Hm1 in the Z direction, and a gap may be set between the edge on the first side 22*c* side of each sub-half score Hs and the first side 22*c*. Further, each sub-half score Hs extends from the position separated from the first main half score Hm1 toward the first side 22*c* in the Z direction, and a gap may be set between the edge on the first main half score Hm1 side of each sub-half score Hs and the first main half score Hm1. The gap is set at, for example, about 1 mm to 3 mm.

From the viewpoint of facilitating guiding of peeling of the intermediate layer I of the corrugated paper by an opening operation described later, or the like, the edge on the first side 22*c* side of each sub-half score Hs may be in contact with the first side 22*c*, and the edge on the first main half score Hm1 side may be in contact with the first main half score Hm1. The direction of extension of the sub-half score Hs may only be along the array direction of the ridges and grooves of the corrugated medium of the corrugated paper and is not limited to the direction in parallel with the array direction of the ridges and grooves of the corrugated medium.

Figure 10:
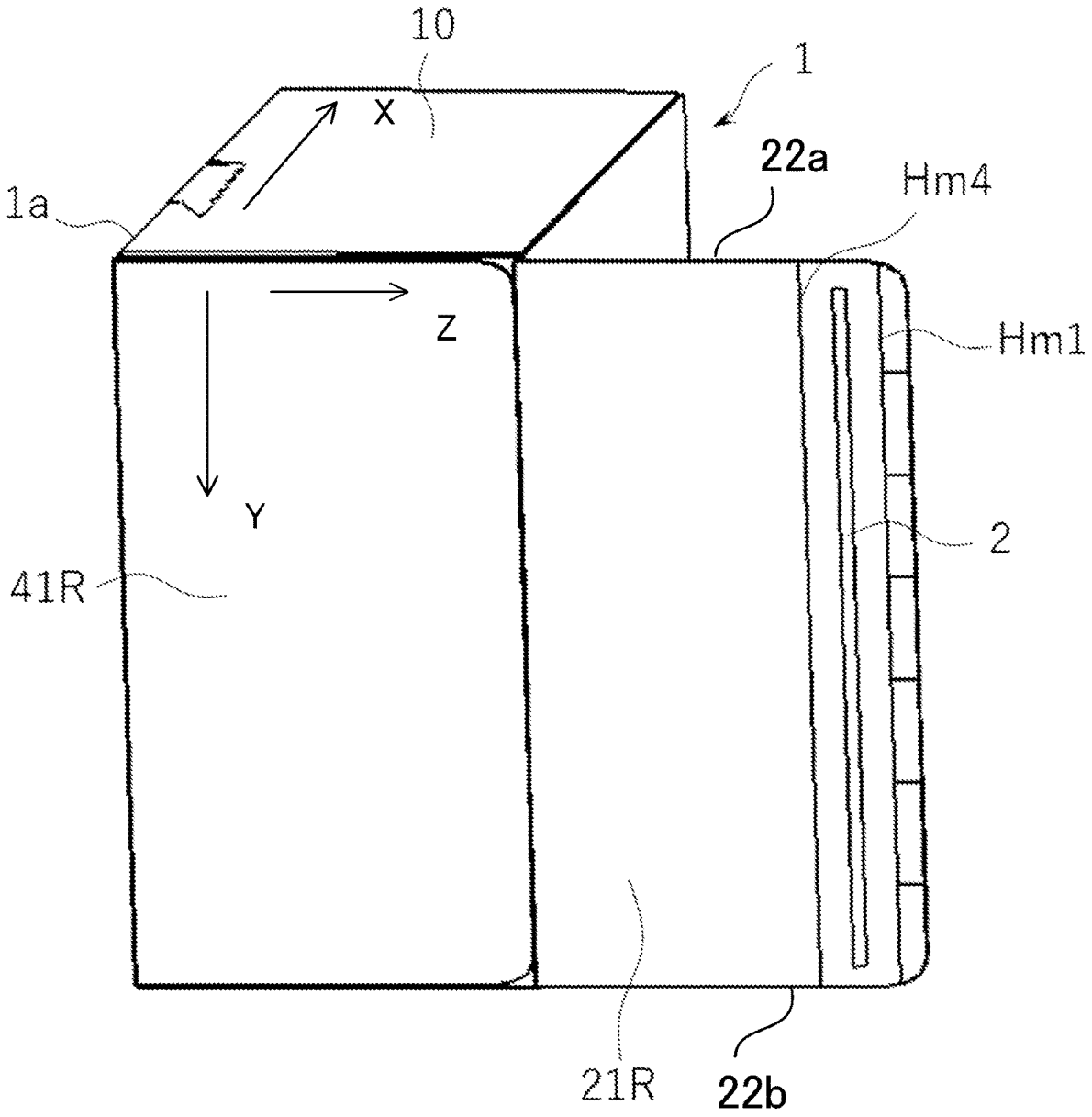
FIG. 10 is a plan view of the right outer rear flap of the packing box showing another example of a half score.

Incidentally, the form of the main half score Hm and the sub-half score Hs of the present Example is an example, and the present invention is not limited to the form. For example, as shown in FIG. 10, as the main half scores Hm, the first main half score Hm1 and the fourth main half score Hm4 may be provided. The fourth main half score Hm4 is obtained by extending the second score (the second main half score Hm2) from the first end (the second side 22*a*) to the second end (the third side 22*b*) in the second direction (Y direction) at the inner surface of the right outer rear flap 21R of the first outer lid part. Namely, the fourth main half score Hm4 is opposed to (extends in parallel with) the first main half score Hm1 across the adhesive 2, is situated with a prescribed spacing from the adhesive 2 and extends from the second side 22*a* to the third side 22*b* in the Y direction. In this case, the fourth main half score Hm4 is provided in vicinity of the adhesion part 2*a* between the adhesion part 2*a* and the hinge part 64R.

Further, the main half score Hm may be set as a discontinuous main half score HmF having discontinuous parts Gm (Gm1 and Gm2) without a score (blade) partially along the extending direction thereof. The main half score Hm set as the discontinuous main half score HmF may be seat as at least any of the first main half score Hm1, the second main half score Hm2, the third main half score Hm3, and the fourth main half score Hm4. Alternatively, at least one of the sub-half scores Hs may be set as the discontinuous sub-half score HsF having a discontinuous part Gs partially along the extending direction thereof. For example, in FIG. 11, the first main half score Hm1 is set as the discontinuous main half score HmF having the discontinuous parts Gm1 and Gm2. Further, the sub-half score Hs1 is set as the discontinuous sub-half score HsF having a discontinuous part Gs.

Figure 11:
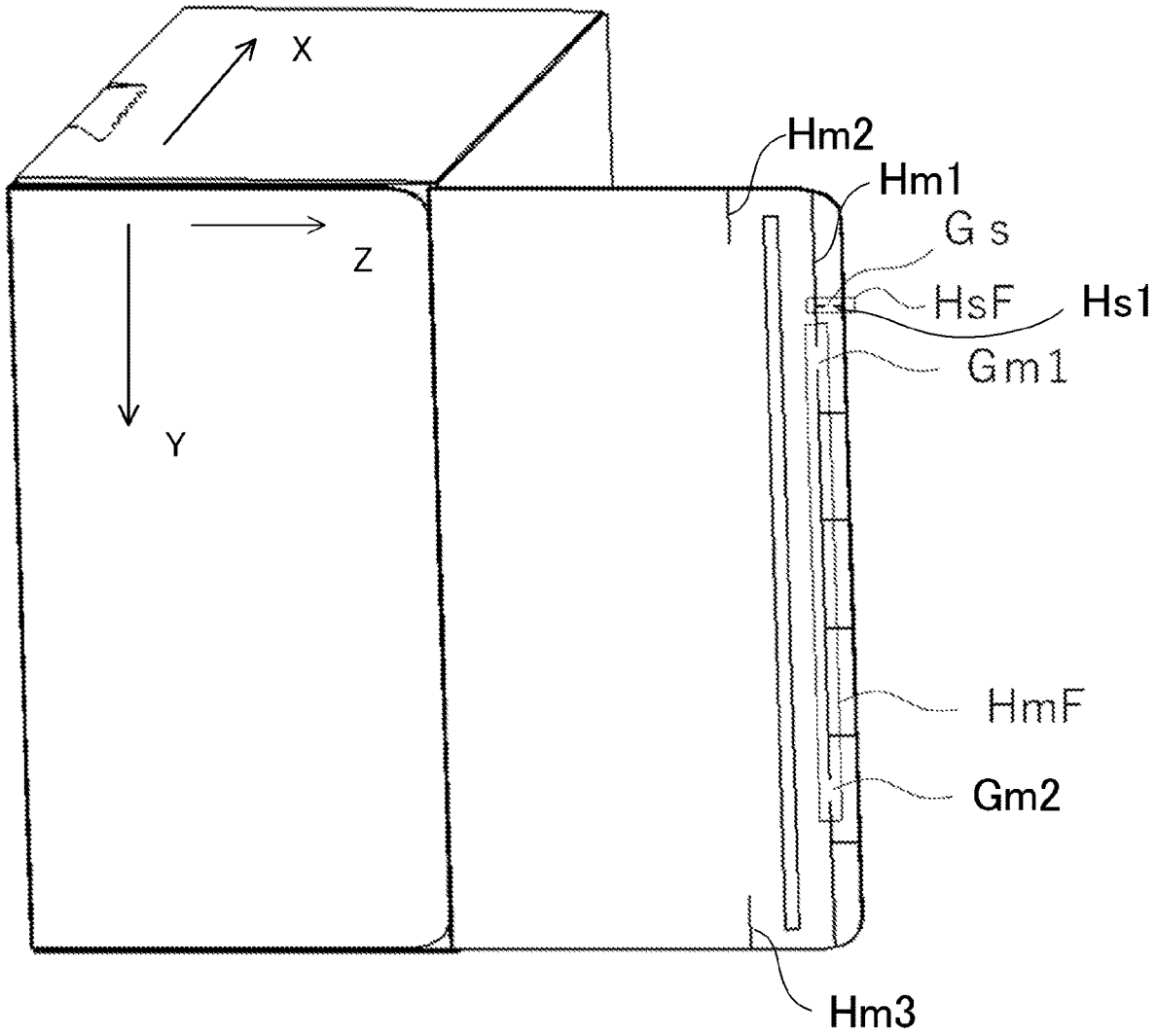
FIG. 11 is a perspective view of a packing box for illustrating another arrangement aspect of a sub-half score.

The main half score Hm and the sub-half score Hs may only be configured so as to leave a trace of opening of the packing box 1 in a form in which, as described later, the right outer rear flap 21R is broken by an opening operation, and further typically, a flap strip 3 (see FIGS. 12 and 13) is separated therefrom. The form of the discontinuous main half score HmF and the discontinuous sub-half score HsF shown in FIG. 11 is an example, and the present invention is not limited to the form. For example, the number and the length of the discontinuous part Gm or Gs are not limited to the example shown. Further, the discontinuous main half score HmF may be formed in a perforation line shape. The discontinuous sub-half score HsF may be formed in a perforation line shape. The discontinuous main half score HmF and the discontinuous sub-half score HsF may be formed in a perforation line shape. Incidentally, the length of the discontinuous part Gm or Gs can be set at, for example, about 1 mm to 3 mm.

Herein, the adhesion part 2*a* to be applied with the adhesive 2 may be provided between the main half scores Hm. As a result of this, even in a case where an operator tries to open the right outer rear flap 21R by grasping the second side 22*a* and the third side 22*b*, or also in a case where an operator tries to open the right outer rear flap 21R by grasping the first side 22*c*, similarly, it becomes possible to clearly leave a trace of opening of the packing box 1. Further, the adhesion part 2*a* may be provided in a sufficient region so as to obtain a sufficient fixing strength with respect to the length direction of the first main half score Hm1 (Y direction). For example, the adhesion part 2*a* may be provided with a length of 70% to 100% of the length of the first main half score Hm1 with respect to the Y direction. However, the present invention is not limited to the configuration in which the adhesion part 2*a* is continuously provided in the length region. The adhesion part 2*a* may also be provided discontinuously so as to obtain a sufficient fixing strength with the foregoing length region. Incidentally, there can be provided an additional adhesion part 2*a* for fixing the right outer rear flap 21R and the right inner front flap 41R according to the size of the packing box 1, or the like.

Incidentally, in the present Example, the configuration for leaving a trace of opening of the packing box 1 in accordance with the present invention (such as the main half score Hm or the sub-half score Hs) is provided at the right outer rear flap 21R. However, the present invention is not limited to such an aspect. For example, assuming that the left outer rear flap 21L is opened as a site other than the genuine opening site, the configuration for leaving a trace of opening of the packing box 1 in accordance with the present invention may be provided at the left outer rear flap 21L. Further, the configuration for leaving a trace of opening of the packing box 1 in accordance with the present invention may be provided at both of the right outer rear flap 21R and the left outer rear flap 21L.

6. Opening of Right Outer Rear Flap

Figure 12:
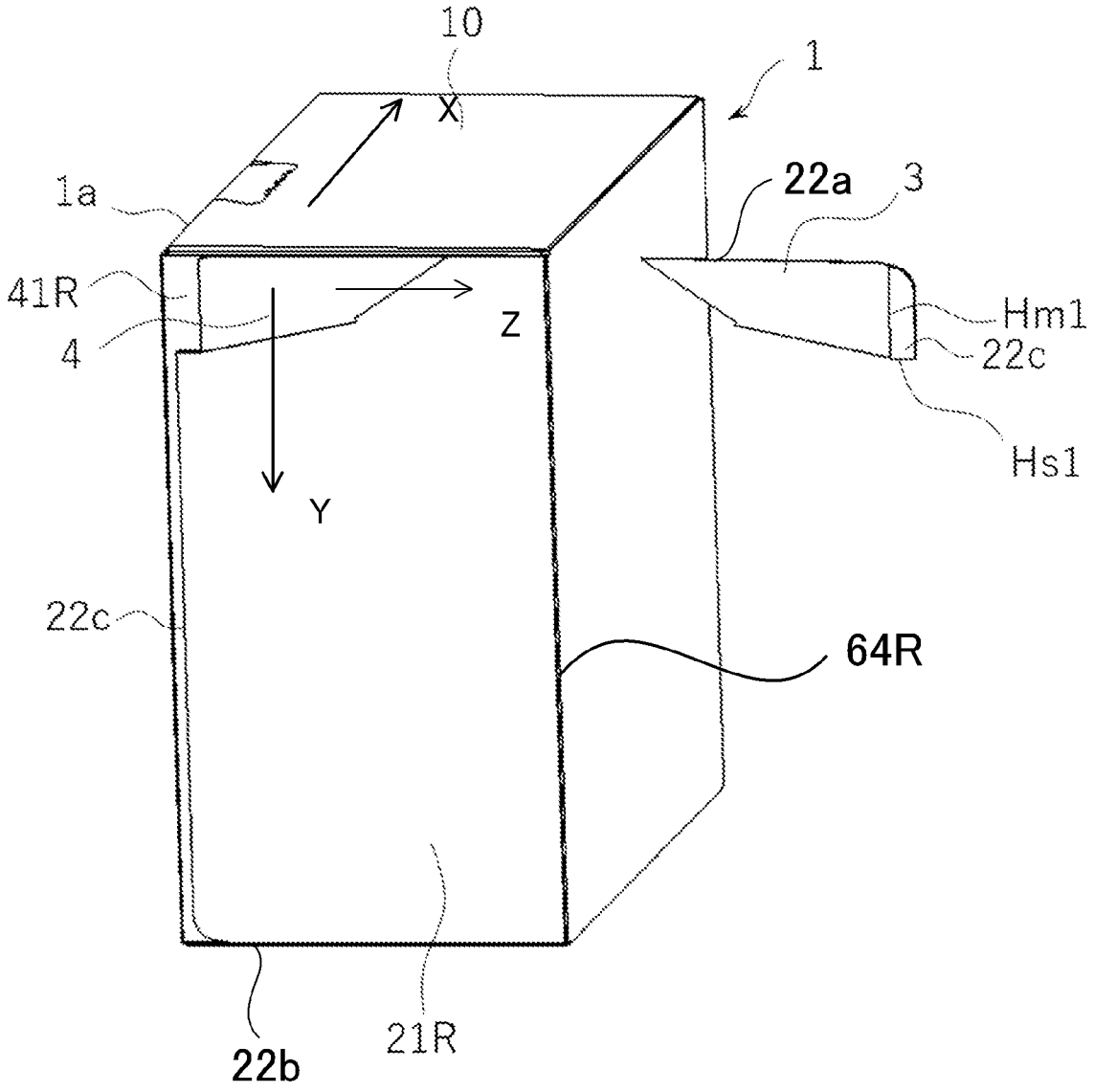
FIG. 12 is a schematic perspective view for illustrating the fraudulent opening operation of the packing box.

Then, a description will be given to opening of the right outer rear flap 21R at the packing box 1 of the present Example. FIG. 12 is a perspective view of the packing box 1 schematically showing one example of a state in which a trace of opening has been left by the opening operation of the right outer rear flap 21R. As for the details of the main half score Hm, the sub-half score Hs, and the adhesion part 2*a* provided at the right outer rear flap 21R, and the like, reference should be also made to FIG. 9.

An operator grasps the external side 22 (typically the first side 22*c*) of the right outer rear flap 21R not bonded with the right inner front flap 41R by the adhesive 2 for opening the right outer rear flap 21R. Then, the operator applies a force in the direction of moving the right outer rear flap 21R away from the right inner front flap 41R and performs an opening operation. The opening operation applies a force onto the corrugated paper front surface F and the intermediate layer I at the portion of the right outer rear flap 21R provided with the half score (the main half score Hm and the sub-half score Hs) particularly according to the grasping position of the operator, or the like as described later. This causes peeling of the intermediate layer I between the corrugated paper front surface F and the corrugated paper rear surface R of the right outer rear flap 21R (typically, the rupture of the corrugated medium 202 of the intermediate layer I), or the interlayer peeling of the liner such as paperboard (outer liner 201*a*) configuring the corrugated paper front surface F from the portion. Herein, both of these may also be referred to as simply "peeling". Further, particularly as described later, division of the right outer rear flap 21R becomes more likely to be caused from the portion provided with the half score (mainly, the sub-half score Hs) according to the grasping position of an operator, and the like.

Then, an operator continues performing the opening operation. Accordingly, for example, as shown in FIG. 12, the peeling and division are involved, typically resulting in separation of the flap strip 3 from the right outer rear flap 21R. As a result of this, typically, in a form in which the flap strip 3 is separated, or even in a case where the flap strip 3 is not fully separated, the peeling breaks the right outer rear flap 21R in a hardly restorable manner, which leaves a trace of opening of the packing box 1. In a case where peeling thus breaks the right outer rear flap 21R, and typically the flap strip 3 is separated from the right outer rear flap 21R, a trace of opening is difficult to set constant according to the start position of opening, how the force upon opening is applied, or the like. Further, typically, it is difficult to restore the trace of opening left behind in such a manner as to rupture the corrugated medium 202 of the corrugated paper intermediate layer I to the state before opening by, for example, adhesion. For this reason, it becomes difficult to hide the trace of opening of the packing box 1.

A more detailed description will be given to the opening operation of the right outer rear flap 21R. FIG. 12 is a perspective view schematically showing the packing box 1 with a trace of opening left behind in a case where the grasping position of an operator is the first side 22*c* at a position closer to the second side 22*a* than the sub-half score Hs1 in the Y direction. In this case, an operator grasps the first side 22*c* at a position not bonded with the right inner front flap 41R by the adhesive 2, and closer to the second side 22*a* than substantially the center in the Y direction and starts an opening operation in such a manner as to separate the right outer rear flap 21R from the right inner front flap 41R. At the position of the right outer rear flap 21R close to the second side 22*a* in the Y direction, a sub-half score Hs1 is provided between the first side 22*c* and the first main half score Hm1. For this reason, in a case where the grasping position is grasped, to start an opening operation, the right outer rear flap 21R tends to be divided in the Y direction with the sub-half score Hs1 as a starting point.

Then, in a case where the right outer rear flap 21R in the vicinity of the second side 22*a* grasped by the operator is turned up to the vicinity of the first main half score Hm1, the corrugated paper front surface F and the intermediate layer I at the portion provided with the first main half score Hm1 of the right outer rear flap 21R are applied with a force. As a result of this, the peeling is caused in the right outer rear flap 21R from the portion of the first main half score Hm1 closer to the second side 22*a* than the sub-half score Hs1 in the Y direction and the sub-half score Hs1. Then, in a case where the operator continues performing the opening operation of the right outer rear flap 21R while involving the peeling, typically, the portion of the right outer rear flap 21R grasped by the operator separates as the flap strip 3 from the remaining part 4. At this step, the flap strip 3 is separated from the remaining part 4 in the vicinity of the hinge part 64R as shown in FIG. 12 or is separated from the remaining part 4 in such a manner as to be peeled before the hinge part 64R in the Z direction. As a result of this, typically, in the form in which the flap strip 3 is separated, or even in a case where the flap strip 3 is not fully separated, the peeling breaks the right outer rear flap 21R in a hardly restorable manner, which clearly leaves a trace of opening of the packing box 1.

Herein, in a case where the operator further continues performing opening, thereby trying to take out the cartridge P from the packing box 1, the process goes to the following operation. Namely, in the same manner as described above, the portion closer to the third side 22*b* in the Y direction of the right outer rear flap 21R is also opened, the remaining part 4 is peeled from the right inner front flap 41R, and the right inner front flap 41R is opened.

In the present Example, the right outer rear flap 21R is provided with a plurality of sub-half scores Hs at substantially equal intervals in the Y direction. Therefore, also in a case where the grasping position in the Y direction of an operator is changed, the right outer rear flap 21R tends to be divided in the Y direction with the sub-half score Hs closer to the grasping position as the starting point. Accordingly, even in a case where the position of the sub-half score Hs to be divided is changed with respect to the case of FIG. 12, as with the case of FIG. 12, the right outer rear flap 21R is broken in a hardly restorable manner, which clearly leaves a trace of opening of the packing box 1.

Then, FIG. 13 is a perspective view schematically showing the packing box 1 with a trace of opening left behind in a case where the grasping portion of an operator is at the second side 22*a*. In this case, the operator grasps the second side 22*a* not bonded with the right inner front flap 41R by the adhesive 2 and starts an opening operation in such a manner as to separate the right outer rear flap 21R from the right inner front flap 41R. In the present Example, the second main half score Hm2 is provided so as to extend from the second side 22*a* of the right outer rear flap 21R. For this reason, in a case where the operator starts the opening operation by grasping the second side 22*a*, the right outer rear flap 21R tends to be divided in the Z direction with the second main half score Hm2 as the starting point. Then, in a case where the right outer rear flap 21R is turned up to the terminal of the second main half score Hm2 grasped by the operator, the half score disappears, and division becomes less likely to be caused. Typically, a bent piece 5 is generated with the tip of division as the starting point, and the flap strip 3 is turned up, and the right outer rear flap 21R is broken in a hardly restorable manner, which clearly leaves a trace of opening of the packing box 1.

In the present Example, the right outer rear flap 21R is provided with the main half scores Hm, and the sub-half scores Hs substantially symmetrical with respect to substantially the center in the Y direction. Therefore, although the trace of opening in the case where the grasping position of the operator is at the third side 22*b* is reversed in positional relationship in the Y direction with respect to FIG. 13, the trace is the same as with the bent piece 5 or the flap strip 3 of FIG. 13.

Incidentally, at least one sub-half score Hs extending from the adjacent part (typically the contact part) with the first side 22*c* to the adjacent part (typically the contact part) with the first main half score Hm1 is required. As a result of this, the sub-half score Hs guides the peeling or division in cooperation with the first main half score Hm1. This makes it easy to clearly leave a trace of opening of the packing box 1.

For example, assuming that an operator grasps the second side 22*a*, thereby opening the right outer rear flap 21R, in a case where the length of the second side 22*a* is relatively longer, or in other cases, the sub-half score Hs may be provided. As a result of this, it is possible to suppress the force required for dividing the portion to cause the peeling midway in the length direction of the first main half score Hm1 and causing the peeling from becoming larger than the force required for tearing off the adhesion part by the adhesive 2. This facilitates leaving of a trace of opening due to the peeling.

Particularly, in accordance with the arrangement aspect of the sub-half scores Hs of the present Example shown in FIG. 9, in either case where an operator tries to open the right outer rear flap 21R by grasping any of the second side 22*a* and the third side 22*b*, similarly, it becomes easy to clearly leave a trace of opening of the packing box 1.

7. Suppression of Buckling with Half Score Set as Score

In the present Example, the right outer rear flap 21R of the first outer lid part is configured such that the array direction of the corrugated medium may become the third direction (Z direction), and the first main half score Hm1 formed of a half score on the inner surface of the right outer rear flap 21R is provided along the second direction (Y direction) intersecting the third direction. For this reason, it is possible to suppress the reduction of the strength of the corrugated paper configuring the right outer rear flap 21R due to the formation of the first main half score Hm1. Further, the second main half score Hm2 and the third main half score Hm3 are also half scores extending in the second direction (Y direction), and each does not have the portion cut in the third direction (Z direction). For this reason, it is possible to suppress the reduction of the strength of the corrugated paper configuring the right outer rear flap 21R due to the formation of the second main half score Hm2 and the third main half score Hm3. Accordingly, in a case where a load in the Y direction is applied, it is possible to suppress the generation of buckling of the corrugated medium led by the half scores. Further, the first main half score Hm1 and the sub-half score Hs are arranged in a region surrounded by the first main half score Hm1, the inclined side 22*d*, the curve part 22*cr*, the first side 22*c*, and the inclined side 22*e*, and having a length in the Y direction shorter than the distance in the Y direction between the second side 22*a* and the third side 22*b*. For this reason, in a case where a load in the Y direction is applied, the half scores are less likely to be applied with a load, so that it is possible to suppress the generation of buckling of the corrugated medium led by the half scores.

As described up to this point, in accordance with the present Example, it becomes possible to leave a trace of opening of the packing box 1 in such an aspect that while suppressing the reduction of the strength of the corrugated paper, the flap is broken by the opening operation, which makes it difficult to disguise the packing box 1 as being unopened by reassembly. Therefore, in accordance with the present Example, it is possible to implement a packing box difficult to disguise as being unopened by reassembly after opening while suppressing the strength reduction.

Others

Up to this point, the present invention has been described by way of specific Examples. However, the present invention is not limited to the Examples. In the Examples, a description has been given to the example in which the rear surface of the right outer rear flap 21R is provided with the first main half score Hm1, the second main half score Hm2, the third main half score Hm3, and the sub-half scores Hs1 to Hs6. However, the configuration having only the first main half score Hm1 is also acceptable. The side most likely to be grasped by a person who tries to perform fraudulent opening of a packing box is considered to be the first side 22*c*. Provision of the first main half score Hm1 can cause peeling of the right outer rear flap 21R with respect to opening from the first side 22*c*, which enables opening in a hardly restorable manner. By further providing the second main half score Hm2 and the third main half score Hm3, it is possible to also cause peeling of the right outer rear flap 21R with respect to opening by grasping the second side 22*a* and the third side 22*b*. This enables opening in a hardly restorable form with more reliability. Further, the provision of the sub-half score Hs makes it easy to cause peeling of the right outer rear flap 21R with respect to opening with the first side 22*c* grasped. This enables opening in a hardly restorable form with more reliability. Incidentally, although in the Example, it is configured such that the first main half score Hm1 extends from the second side 22*a* (the third side 22*b*), the edge on the second side 22*a* side (the edge on the third side 22*b* side) may be separated from the second side 22*a* (the third side 22*b*). In a case where the distance between the edge on the second side 22*a* side (the edge on the third side 22*b* side) of the first main half score Hm1 and the second side 22*a* (third side 22*b*) is shorter than the length of the first side 22*c*, it is possible to obtain the effect of causing peeling of the right outer rear flap 21R with respect to opening from the first side 22*c*.

In the Example, a description has been given by taking the case where the object to be packed of the packing box is a cartridge for use in an image forming apparatus using an electrophotographic process as an example. However, the present invention is not limited to such an aspect. The object to be packed may be a given product in distribution in the market including other consumable products (such as a waste toner container, a belt such as an intermediate transfer belt, or an ink cartridge) in an image forming apparatus, a food item, medical and pharmaceutical products, a quasi-drug, or the like. The size of the packing box, the number of the surfaces of the surrounding wall, and the like may be appropriately set so as to match the object to be packed.

Further, in the Example, the outer flap was formed in a substantially quadrangular shape in a plan view, and may be in a substantially polygonal shape, a substantially circular shape, a substantially elliptical shape, a substantially oval shape, or the like other than a substantially quadrangular shape in a plan view. Also in the cases, the main half score can be typically formed in a substantially similar shape to that of the external side of the outer flap in such a manner as to surround the adhesion part, and the main half score may be formed of only a straight line, may be formed of only a curve, or may be formed of a combination of a straight line and a curve.

Further, for example, in a case where the site corresponding to the right outer rear flap, the site corresponding to the left outer rear flap, or the sites corresponding to the right outer rear flap and the left outer rear flap in the Example is assumed to a genuine opening site, or in other cases, the site corresponding to the top surface plate in the Example may be provided with a configuration for leaving a trace of fraudulent opening in accordance with the present invention. In this case, the joint plate configures the inner lid part to be arranged so as to close at least a part of the opening formed on one side part of the box body capable of housing an object to be packed. Further, in this case, the top surface plate configures the outer lid part to be stacked on at least a part of the surface to be bent at the bending part, and to face the outside of the packing box of the inner lid part.

Further, as the configuration for leaving a trace of opening of the genuine opening site of the packing box, a configuration for leaving a trace of opening in accordance with the present invention is also applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-155603, filed on Sep. 28, 2022, which is hereby incorporated by reference herein in its entirety.

What is claimed is:

1. A packing box formed of corrugated paper having a corrugated medium with a plurality of ridges and grooves arrayed in an array direction, the packing box comprising:

a first side part extending in a first direction and a second direction intersecting the first direction, the first side part having a first edge portion at an edge in the first direction of the first side part and extending in the second direction;

a second side part being opposed to the first side part and extending in the first direction and the second direction, the second side part having a second edge portion being on the same side as the first edge portion in the first direction and extending in the second direction;

an opening surrounded by the first edge portion of the first side part and the second edge portion of the second side part;

an inner lid part provided to be bent along a first bending line so as to close at least a part of the opening and extending in the second direction and a third direction intersecting the first direction and the second direction, the first bending line extending in the second direction at the first edge portion of the first side part;

an outer lid part provided to be bent along a second bending line and extending in the second direction and the third direction, an inner surface of the outer lid part overlapping at least a part of an outer surface of the inner lid part from outside, the second bending line extending in the second direction at the second edge portion of the second side part; and an adhesion part for bonding the inner surface of the outer lid part and the outer surface of the inner lid part, wherein the outer lid part is configured such that the array direction of the ridges and grooves of the corrugated medium is the third direction, and the inner surface of the outer lid part is provided with a score part between an edge opposite to the second bending line in the third direction and the adhesion part, the score part has a score provided along the second direction, and the score does not reach an outer surface opposite to the inner surface of the outer lid part.

2. The packing box according to claim 1, wherein the adhesion part is elongated in the second direction, and the score part extends from a first end to a second end of the outer lid part in the second direction.

3. The packing box according to claim 1, wherein the score part has a discontinuous part partially without the score along the second direction.

4. The packing box according to claim 1, wherein the score part being referred to as a first score part, the inner surface of the outer lid part is provided with a second score part in a region on a side near the second bending line in the third direction with respect to the adhesion part, the second score part has a second score provided along the second direction from a first end to a second end of the outer lid part in the second direction, and the second score does not reach the outer surface of the outer lid part.

5. The packing box according to claim 4, wherein the inner surface of the outer lid part is provided with a third score part in a region on a side near the second bending line in the third direction with respect to the adhesion part, the third score part has a third score provided along the second direction from the second end to the first end of the outer lid part, and the third score does not reach the outer surface of the outer lid part.

6. The packing box according to claim 4, wherein the second score part extends from the first end to the second end of the outer lid part in the second direction at the inner surface of the outer lid part.

7. The packing box according to claim 1, wherein in a case where the score is a first score, the score part has at least one second score extending from the edge opposite to the second bending line in the third direction toward the first score, and the at least one second score does not reach the outer surface of the outer lid part.

8. The packing box according to claim 7, wherein the at least one second score extends to the first score.

9. The packing box according to claim 7, wherein the at least one second score is a plurality of second scores, and the plurality of second scores are arranged along the second direction.

10. The packing box according to claim 5, wherein the inner surface of the outer lid part has at least one fourth score extending from the edge opposite to the second bending line in the third direction toward the first score part, and the fourth score does not reach the outer surface of the outer lid part.

11. The packing box according to claim 10, wherein the at least one fourth score is a plurality of fourth scores, and the plurality of fourth scores are arranged along the second direction.

12. The packing box according to claim 1, wherein the opening being referred to as a first opening, the inner lid part being referred to as a first inner lid part, and the outer lid part being referred to as a first outer lid part, the first side part has a third edge portion at an edge in the second direction that extends in the first direction, the second side part has a fourth edge portion that is on the same side as the third edge portion in the second direction and that extends in the first direction, and a second opening surrounded by the third edge portion and the fourth edge portion is provided, the packing box further comprising:

a second inner lid part provided to be bent along a third bending line so as to close at least a part of the second opening and extending in the first direction and the third direction, the third bending line extending in the first direction at the third edge portion of the first side part; and a second outer lid part provided to be bent along a fourth bending line and extending in the first direction and the third direction, an inner surface of the second outer lid part overlapping at least a part of an outer surface of the second inner lid part from outside, and the fourth bending line extending in the first direction at the fourth edge portion of the second side part, wherein the second outer lid part is sealed by a seal, and the seal is configured so as to be ruptured in a case where the second outer lid part is opened.

13. The packing box according to claim 1, wherein an object to be packed in the packing box is a cartridge for use in an image forming apparatus.

14. The packing box according to claim 1, wherein the corrugated paper has an inner liner, an outer liner, and an intermediate layer having the corrugated medium between the inner liner and the outer liner.

* * * * *